US008441405B2

(12) United States Patent
Tsutsumi et al.

(10) Patent No.: US 8,441,405 B2
(45) Date of Patent: May 14, 2013

(54) SLOT ANTENNA DEVICE INCLUDING A TRANSMISSION LINE TO WAVEGUIDE TRANSFORMER HAVING DIFFERENTIAL FEED PINS

(75) Inventors: Yukako Tsutsumi, Kanagawa-ken (JP); Tetsu Shijo, Tokyo (JP); Takayoshi Ito, Kanagawa-ken (JP); Shuichi Obayashi, Kanagawa-ken (JP); Hiroki Shoki, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 191 days.

(21) Appl. No.: 12/634,162

(22) Filed: Dec. 9, 2009

(65) Prior Publication Data

US 2010/0148892 A1 Jun. 17, 2010

(30) Foreign Application Priority Data

Dec. 12, 2008 (JP) ..... 2008-317003

(51) Int. Cl.
*H01Q 13/22* (2006.01)
*H01P 5/103* (2006.01)

(52) U.S. Cl.
USPC ..... 343/771; 333/26

(58) Field of Classification Search ..... 333/26, 333/34, 248, 113, 115; 343/771
See application file for complete search history.

(56) References Cited

U.S. PATENT DOCUMENTS 6,483,396 B1 * 11/2002 Kwon et al. ..... 333/108
6,573,810 B2 * 6/2003 Cayrou et al. ..... 333/135

FOREIGN PATENT DOCUMENTS

JP 2005-204344 7/2005

* cited by examiner

*Primary Examiner* — Benny Lee
(74) *Attorney, Agent, or Firm* — Oblon, Spivak, McClelland, Maier & Neustadt, L.L.P.

(57) ABSTRACT

A transformer between a waveguide and a transmission-line includes a high-frequency circuit module, transmission-lines, a waveguide, and feed pins. The high-frequency circuit module has differential-pair terminals to input and output a differential signal. The transmission-lines are connected to the differential-pair terminals. The waveguide includes first to third metal walls. The feed pins are connected to the transmission-lines inside of the waveguide. The feed pins have a first distance of approximately ($\lambda g/2$) from each other. One of the feed pins has a second distance of approximately ($\lambda g*(1+2\alpha)/4$) from the third metal plane. "$\lambda g$" is a wavelength in the waveguide and "$\alpha$" is an integer which is equal or larger than "0". Each of the feed pins has a third distance of approximately (a/2) from the first or second wall. "a" is length of the waveguide along the third metal wall.

8 Claims, 27 Drawing Sheets

SLOT ANTENNA DEVICE INCLUDING A TRANSMISSION LINE TO WAVEGUIDE TRANSFORMER HAVING DIFFERENTIAL FEED PINS

CROSS REFERENCE TO RELATED APPLICATIONS

This application is based upon and claims the benefit of priority from the Japanese Patent Application No. 2008-317003, filed on Dec. 12, 2008, the entire contents of which are incorporated herein by reference.

BACKGROUND OF THE INVENTION

1. Field of the Invention

The present invention relates to an antenna device and a transformer between a waveguide and a transmission-line.

2. Description of the Related Art

High-frequency waves experience a large loss through a waveguide relative to its length because they have a short wavelength. Therefore, an antenna element and a high-frequency circuit are better suited to be close to each other in order to decreases the loss in the waveguide. Size of the antenna element becomes smaller with shortening of the wavelength. It is difficult to make such a small antenna element with high precision. Moreover, not only an antenna element but also a feed circuit and the high-frequency circuit preferably have small sizes in order to minimize size of a radio apparatus.

One technique to minimize the size of the antenna element, the feed circuit and the high-frequency circuit is disclosed in JP-A 2005-204344 (KOKAI). In this reference, the antenna element (which is a waveguide array including several waveguides), the feed circuit and the high-frequency circuit are integrated in a slot array antenna device. Each waveguide is formed by depositing an electric conductor on the surface of a dielectric block. The waveguide array is formed by combining several waveguides and then forming slots on the waveguide array by photolithography. Moreover, the feed circuit and the high-frequency circuit are stacked on the waveguide array.

In the above-mentioned reference, because the waveguide array and the high-frequency circuit are set to be close to each other by stacking the antenna elements, the feed circuit and the high-frequency circuit, a slot antenna device is small and lightweight. Moreover, photolithography can realize higher manufacturing precision as compared with machining.

However, the antenna device becomes thicker because there are three layers of the antenna element, the feed circuit and the high-frequency circuit. Moreover, the antenna device needs a balun in order to convert a differential signal to a single-ended signal. Therefore, the structure of the antenna device becomes complex.

SUMMARY OF THE INVENTION

According to one aspect of the invention, a transformer between a waveguide and a transmission-line includes:

a high-frequency circuit module having differential-pair terminals through which a differential signal is input and output;

transmission-lines, each being connected to one of the differential-pair terminals;

a waveguide including first and second metal walls parallel to each other and one ends of the first and second metal walls are connected to each other by a third metal wall; and feed pins being arranged inside of the waveguide, each being connected to one of the transmission-lines, having a first distance of approximately ($\lambda g/2$) away from each other, one of the feed pins having a second distance of approximately ($\lambda g*(1+2\ \alpha)/4$) away from the third metal plane, "$\lambda g$" is a wavelength in the waveguide, and "$\alpha$" is an integer which is equal or larger than "0", wherein each of the feed pins has a third distance of approximately (a/2) away from the first or second wall, "a" is length of the waveguide along the third metal wall.

According to other aspect of the invention, a transformer between a waveguide and a transmission-line, includes:

a high-frequency circuit module having differential-pair terminals through which a differential signal is input and output;

transmission-lines, each being connected to one of the differential-pair terminals;

a waveguide including first and second metal walls parallel to each other and one ends of the first and second metal walls are connected to each other through a third metal wall; and feed pins being arranged inside of the waveguide, each being connected to one of the transmission-lines, the feed pins having a second distance of approximately ($\lambda g*(1+2\alpha)/4$) away from the third metal plane, "$\lambda g$" is a wavelength in the waveguide, and "$\alpha$" is an integer which is equal or larger than "0", wherein each of the feed pins has a third distance of approximately (a/4) away from the first or second wall, "a" is length of the waveguide along the third metal wall.

According to other aspect of the invention, an antenna device, includes transformers; and an aperture or slots being provided in the waveguide of the transformer in order to radiate radio waves.

DETAILED DESCRIPTION OF THE INVENTION

The embodiments will be explained with reference to the accompanying drawings, wherein like features are denoted by the same reference numbers throughout the drawings and may not be described in detail in all the drawings in which they appear.

Description of the First Embodiment

Figure 1:
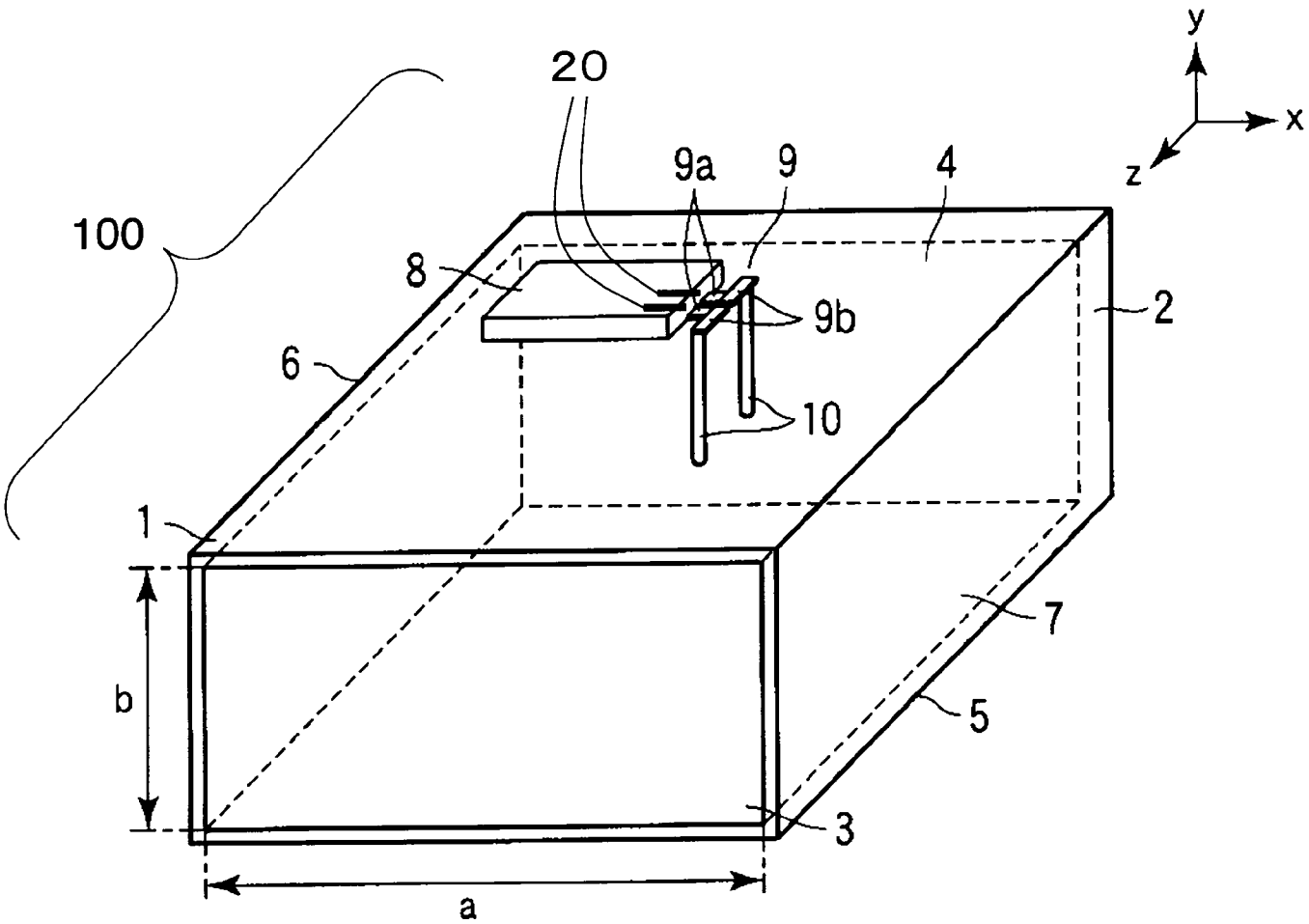
FIG. 1 is a perspective view of a transformer between a waveguide and a transmission-line according to the first embodiment.

As shown in FIG. 1, a transformer between waveguide and transmission-line 100 includes a waveguide 1 which has a rectangle shape, an high-frequency circuit module 8, two transmission-lines 9, and feed pins 10. The waveguide 1 includes a first end plane 2 which is made of metal, a second end plane 3 which is open, an upper wall 4, a lower wall 5, side walls 6, 7. X-axis, y-axis and z-axis are set as shown in FIG. 1.

The high-frequency circuit module 8 is set on the waveguide 1. However, the high-frequency circuit module 8 may be set at another place, for example, under the waveguide 1. The high-frequency circuit module 8 includes a receiving circuit (not shown) and/or a transmitting circuit (not shown). The high-frequency circuit module 8 converts a low-frequency signal to a high-frequency signal which is transmitted through air as a radio wave. The high-frequency circuit module 8 also converts the high-frequency signal which is received from air to the low-frequency signal which is input to another circuit (not shown). The high-frequency circuit module 8 also includes differential-pair terminals 20.

The differential-pair terminals 20 operate as an input unit when a signal is received and an output unit when the signal is transmitted. The differential-pair terminals 20 may be shared to receive and transmit the signal. Alternatively, two pairs of the differential-pair terminals 20 may exist to receive the signal and to transmit the signal, respectively.

Each differential-pair terminal 20 of the high-frequency circuit module 8 is connected to each of the two transmission-lines 9. Each transmission-line 9 includes a drawn-line 9*a* and a derived-line 9*b*. One end of the drawn-line 9*a* is connected to the differential-pair terminal 20 of the high-frequency circuit module 8. The other end of the drawn-line 9*a* is connected to one end of the derived-line 9*b*. The derived-line 9*b* is set along the z-axis. The other end of the derived-line 9*b* is connected to the feed pin 10.

The feed pin 10 may be made of metal such as copper, aluminum, silver and gold. Two feed pins 10 are arranged at middle of the side walls 6, 7 parallel to a zy-plane inside the waveguide 1. One of the feed pins 10 has a distance of ($\lambda g*(1+2\alpha)/4$) away from the first end plane 2 as shown in FIG. 2B. "$\lambda g$" is a wavelength in waveguide along the z-axis. "$\alpha$" is an integer which is equal or larger than "0". The two feed pins 10 are also arranged with interval of ($\lambda g/2$) from each other as shown in FIG. 2B. The length of each feed pin 10 depends on a wave frequency.

In the first embodiment, the waveguide 1 includes several metal plates. The waveguide 1 may include metal post-walls having many through holes instead of the metal walls. Generally, a waveguide has some modes which are pattern of electric field, such as a dominant mode (herein after, "TE10 mode") and higher order modes (hereinafter, refer to one of the higher order modes as "TE20 mode"). In the first embodiment, the waveguide 1 has a size to generate the TE10 mode. In FIG. 1, the length of the waveguide 1 along the x-axis is "a" and the length of the waveguide 1 along the y-axis is "b". "a" is ($\lambda/2<a$), where "$\lambda$" is a free-space wavelength. When "a" is nearly equal to "2*b", "a" is ($\lambda/2<a<\lambda$) in order to avoid generating the higher order modes.

The wavelength in waveguide "$\lambda g$" is the expression (1), where "$\lambda c$" is a cut-off wavelength.

$$\lambda\sqrt{(1-(\lambda/\lambda_c)^2)} \tag{1}$$

"$\lambda c$" equals "2*a" in the TE10 mode.

Next, operation of the transformer between waveguide and transmission-line 100 for transmission will be explained using FIGS. 2A, 2B, 2C.

Figure 2A:
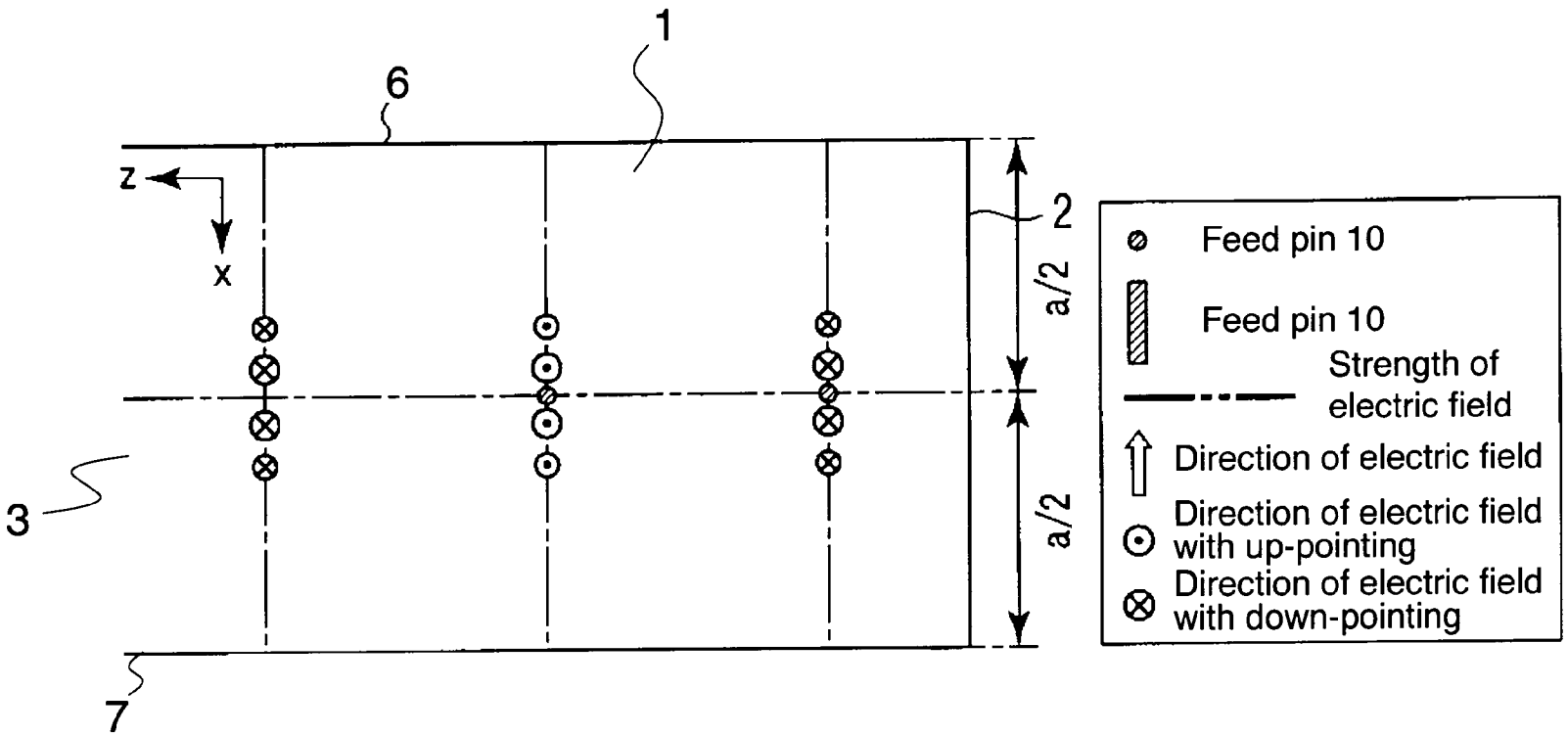
FIGS. 2A, 2B, and 2C are sectional views of the transformer between a waveguide and a transmission-line.
Figure 2B:
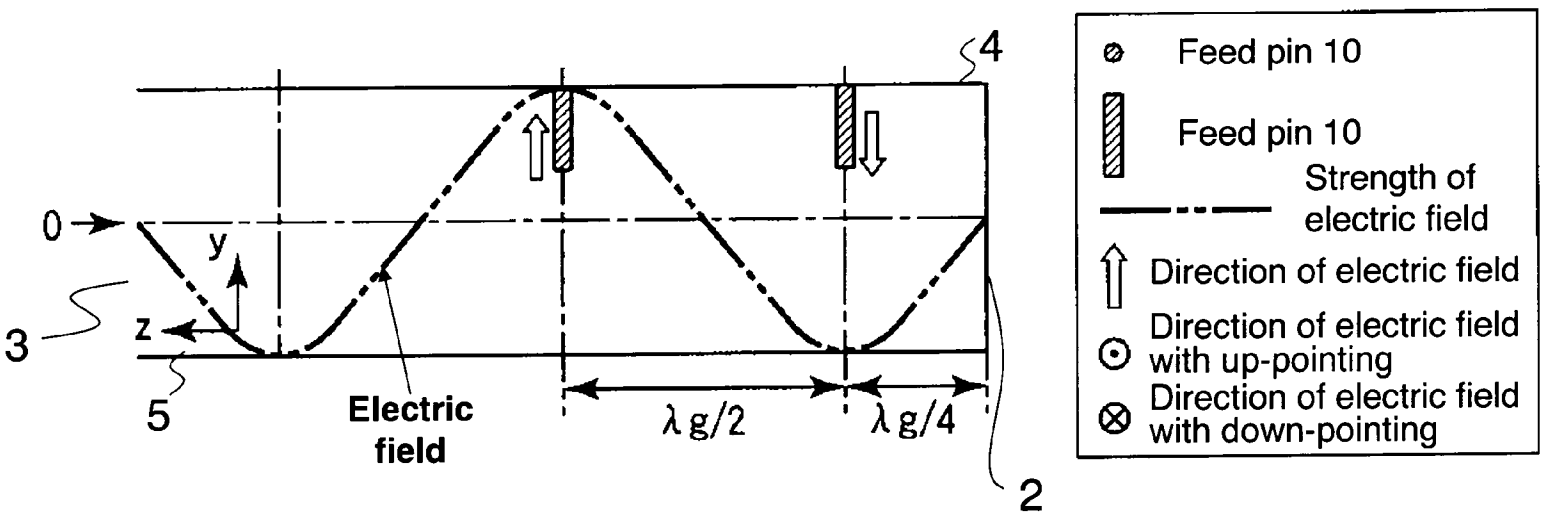
Figure 2C:
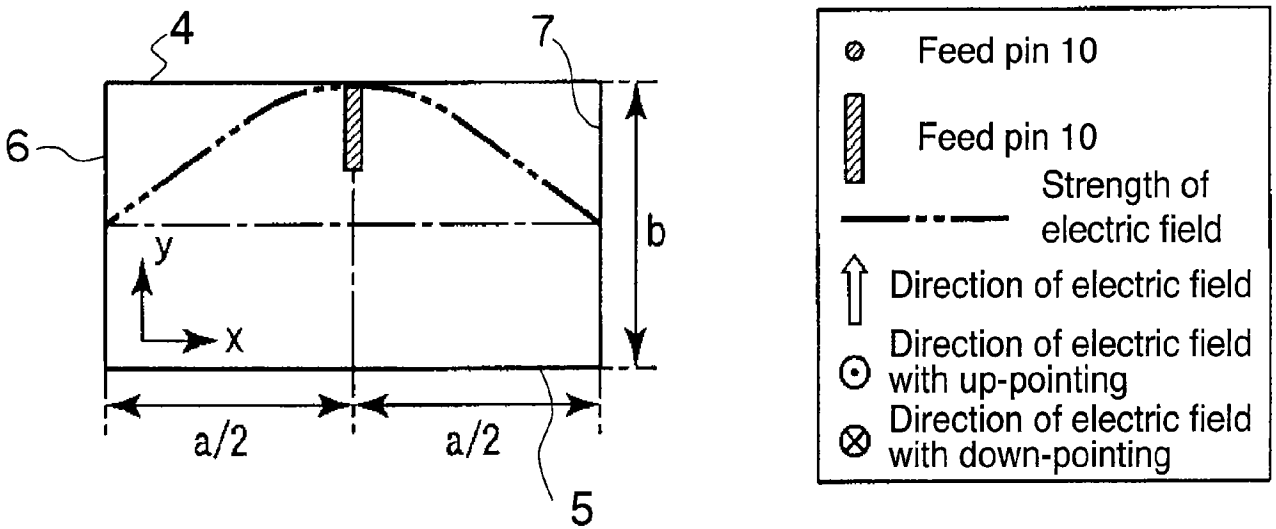

FIGS. 2A, 2B, 2C show cross-sections along the xz-plane, yz-plane, xy-plane of FIG. 1, respectively. The high-frequency circuit module 8 and the transmission-lines 9 of FIG. 1 are not shown for simplicity. The electric field is based on the TE10 mode. FIGS. 2A, 2B, 2C show the feed pin 10, the strength of electric field, and the direction of electric field, and with both up-pointing and down pointing.

As shown in FIG. 2C, strength of the electric field is "0" (node) at side walls 6, 7. Moreover, the strength of the electric field is maximum (loop) at a center of the waveguide at a distance of (a/2) has been inserted prior to "side" side walls 6,7.

As shown in FIG. 2B, the strength of the electric field is "0" (node) at the first end plane 2. Moreover, the strength of the electric field has loops at positions having a distance of $\lambda g*((1+2\alpha)/4)$ away from the first end plane 2, where "$\alpha$" is an integer which is equal or larger than "0". Adjacent loops of the electric field have opposite phases from each other as designated by the oppositely directed arrows.

Differential signals, which have opposite phases from each other, are current in the two feed pins 10. These differential signals generate the electric fields with opposite phases from each other and the electric field is based on the TE10 mode. As a result, the feed pins 10, which are arranged as shown in FIG. 1, generate a single-ended signal of the TE10 mode for transmission.

In the case of reception, the single-ended signal of the TE10 mode is converted to the differential signal in the feed pin 10 by performing inverse operations from operations for transmission.

According to the first embodiment, the transformer between waveguide and transmission-line 100 converts the differential signal to the single-ended signal in the TE10 mode without a complex structure such as using a balun. Moreover, the antenna device using the transformer between waveguide and transmission-line 100 can be thinner because it does not have a layer of a feed circuit.

Description of the Second Embodiment

Figure 3:
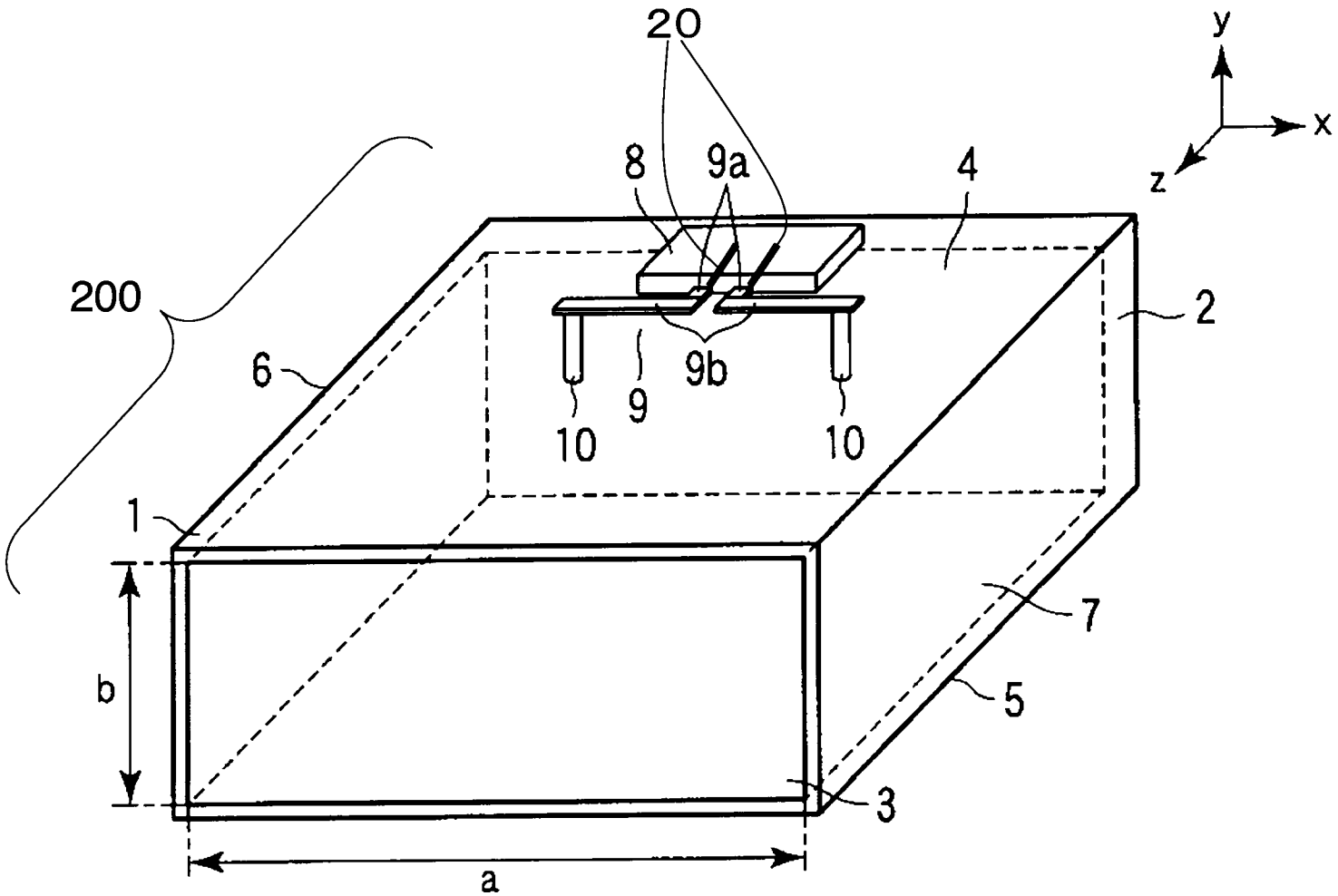
FIG. 3 is a perspective view of a transformer between a waveguide and a transmission-line according to the second embodiment.

As shown in FIG. 3, a transformer between waveguide and transmission-line 200 is almost same as that in the first embodiment except that two transmission-lines 9 and feed pins 10 are arranged parallel to the xy-plane. In FIGS. 2A and 2C, the length of the waveguide 1 along the x-axis is "a" and the length of the waveguide 1 along the y-axis is "b".

In the second embodiment, the high-frequency circuit module 8 is set on the waveguide 1. However, the high-frequency circuit module 8 may be set at another place, for example, under the waveguide 1. Since the high-frequency circuit module 8 is the same as the first embodiment, the detail explanation is skipped.

Each differential-pair terminals 20 of the high-frequency circuit module 8 is connected to each of the two transmission-lines 9. Each transmission-line 9 includes a drawn-line 9*a* and a derived-line 9*b*. One end of the drawn-line 9*a* is connected to the differential-pair terminal of the high-frequency circuit module 8. The other end of the drawn-line 9*a* is connected to one end of the derived-line 9*b*. The derived-line 9*b* is set along the x-axis. The other end of the derived-line 9*b* is connected to the feed pin 10.

Two feed pins 10 are arranged parallel to a xy-plane inside the waveguide 1. The two feed pins 10 have a distance of ($\lambda g*(1+2\alpha)/4$) away from the first end plane 2. "$\lambda g$" is a wavelength in waveguide along the z-axis. "$\alpha$" is an integer which is equal or larger than "0". The two feed pins 10 also have a distance of (a/4) away from the side walls 6, 7, respectively.

In the second embodiment, the waveguide 1 has a size to generate the TE20 mode. "a" is ($\lambda<a$), where "$\lambda$" is a free-space wavelength.

The wavelength in waveguide "$\lambda g$" is following the expression (1), where "$\lambda c$" is a cut-off wavelength. "$\lambda c$" equals "a" in the TE20 mode.

Next, operation of the transformer between waveguide and transmission-line 200 for transmission will be explained using FIGS. 4A, 4B, and 4C.

Figure 4A:
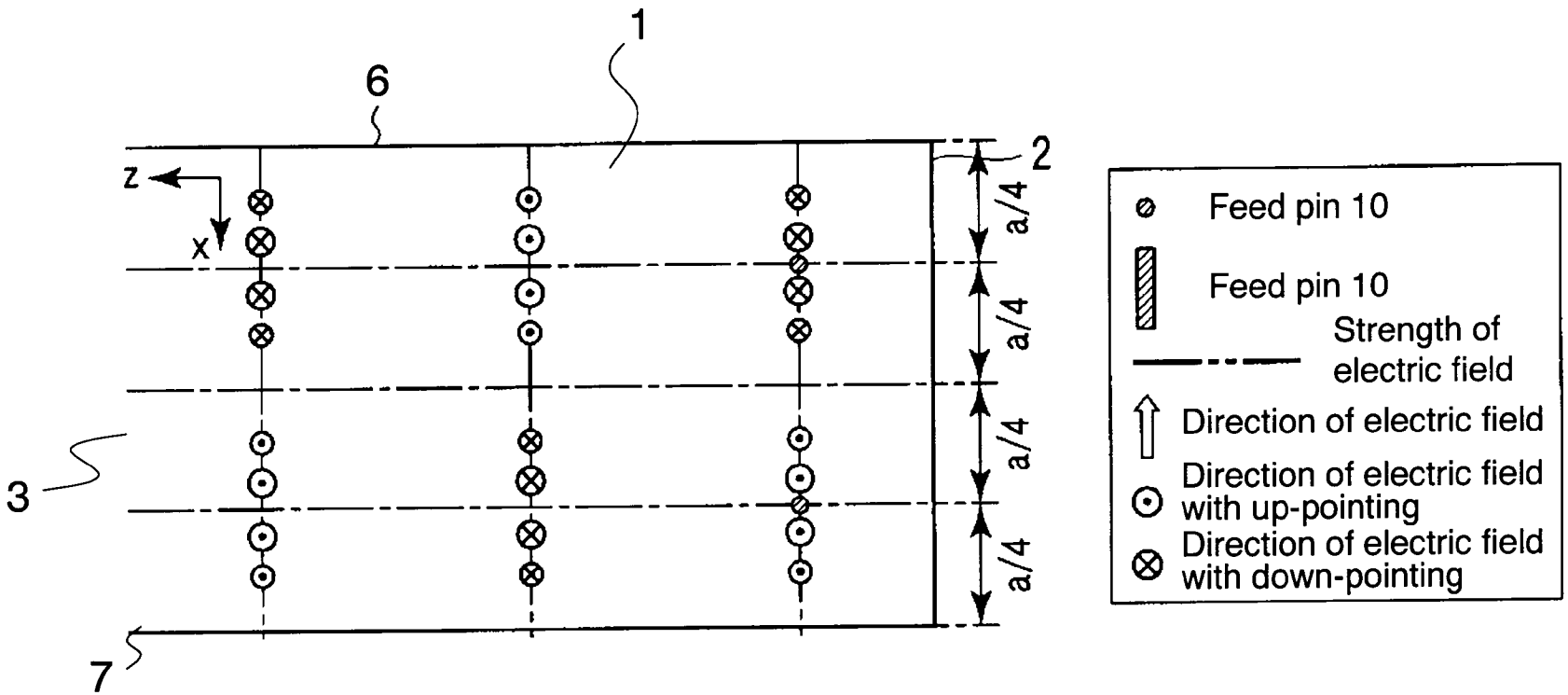
FIGS. 4A, 4B, and 4C are sectional views of the transformer between a waveguide and a transmission-line.
Figure 4B:
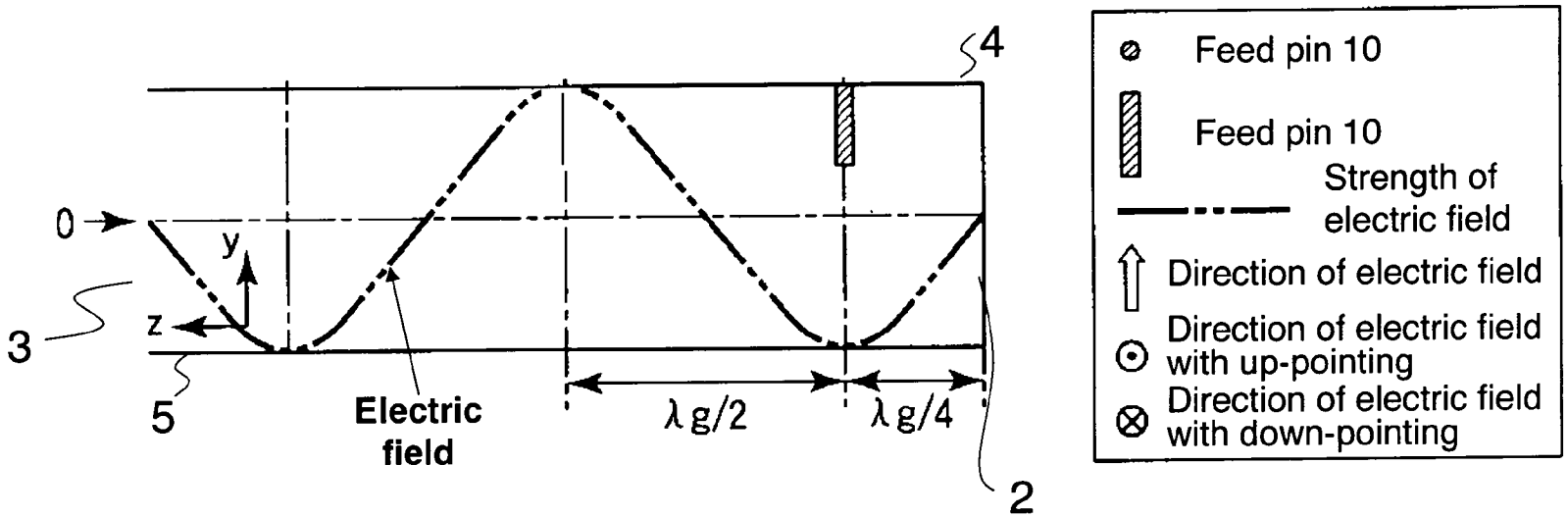
Figure 4C:
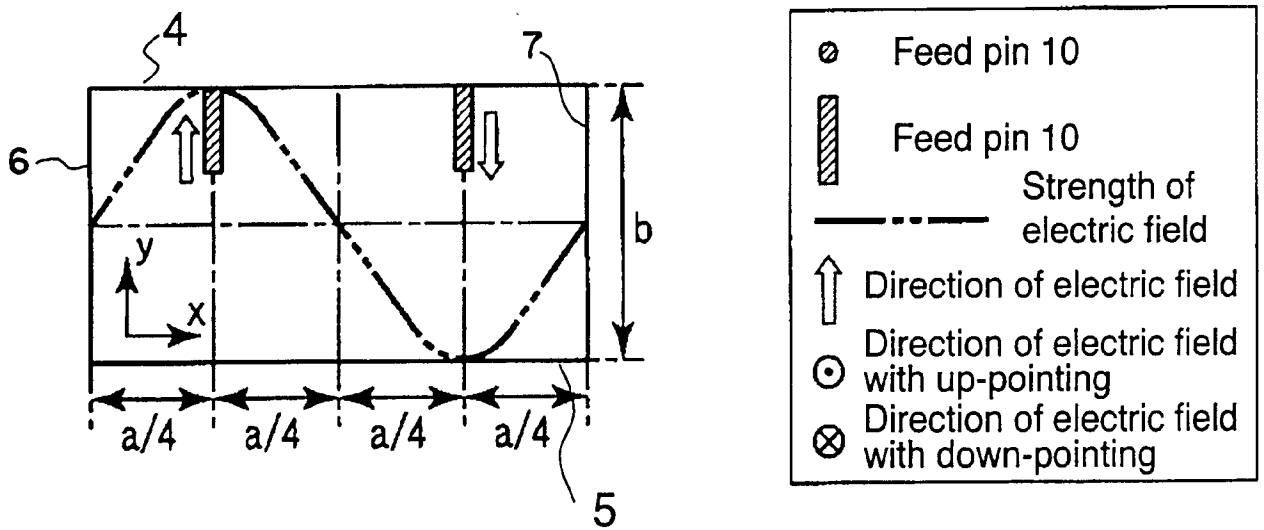

FIGS. 4A, 4B, and 4C show cross-sections along the xz-plane, yz-plane, xy-plane of FIG. 3, respectively. The high-frequency circuit module 8 and the transmission-lines 9 are not shown for simplicity. The electric field is based on the TE20 mode. FIGS. 4A, 4B, 4C show the feed pin 10, the strength of electric field, and the direction of electric field, and with both up-pointing and down pointing.

As shown in FIG. 4C, strength of the electric field is "0" (node) at side walls 6, 7. Moreover, the strength of the electric field has loops at positions having a distance of (a/4) from the side walls 6,7.

As shown in FIG. 4B, the strength of the electric field is "0" (node) at the first end plane 2. Moreover, the strength of the electric field has loops at positions having a distance of ($(1+2\alpha)/4$) away from the first end plane 2, where "$\alpha$" is an integer which is equal or larger than "0". Adjacent loops of the electric field have opposite phases.

The differential signals, which have opposite phases from each other, are current in the two feed pins 10. These differential signals generate the electric fields with opposite phases from each other and the electric field is based on the TE20 mode. As a result, the feed pins 10, which are arranged as shown in FIG. 3, generate the single-ended signal of the TE20 mode for transmission.

In the case of reception, the single-ended signal of the TE20 mode is converted to the differential signal in the feed pin 10 by performing inverse operation with transmission.

According to the second embodiment, the transformer between waveguide and transmission-line 200 converts the differential signal to the single-ended signal in the TE20 mode without a complex structure such as using a balun. Moreover, the antenna device using the transformer between waveguide and transmission-line 200 can be thinner because it does not have the layer of the feed circuit.

Description of the Third Embodiment

Figure 5:
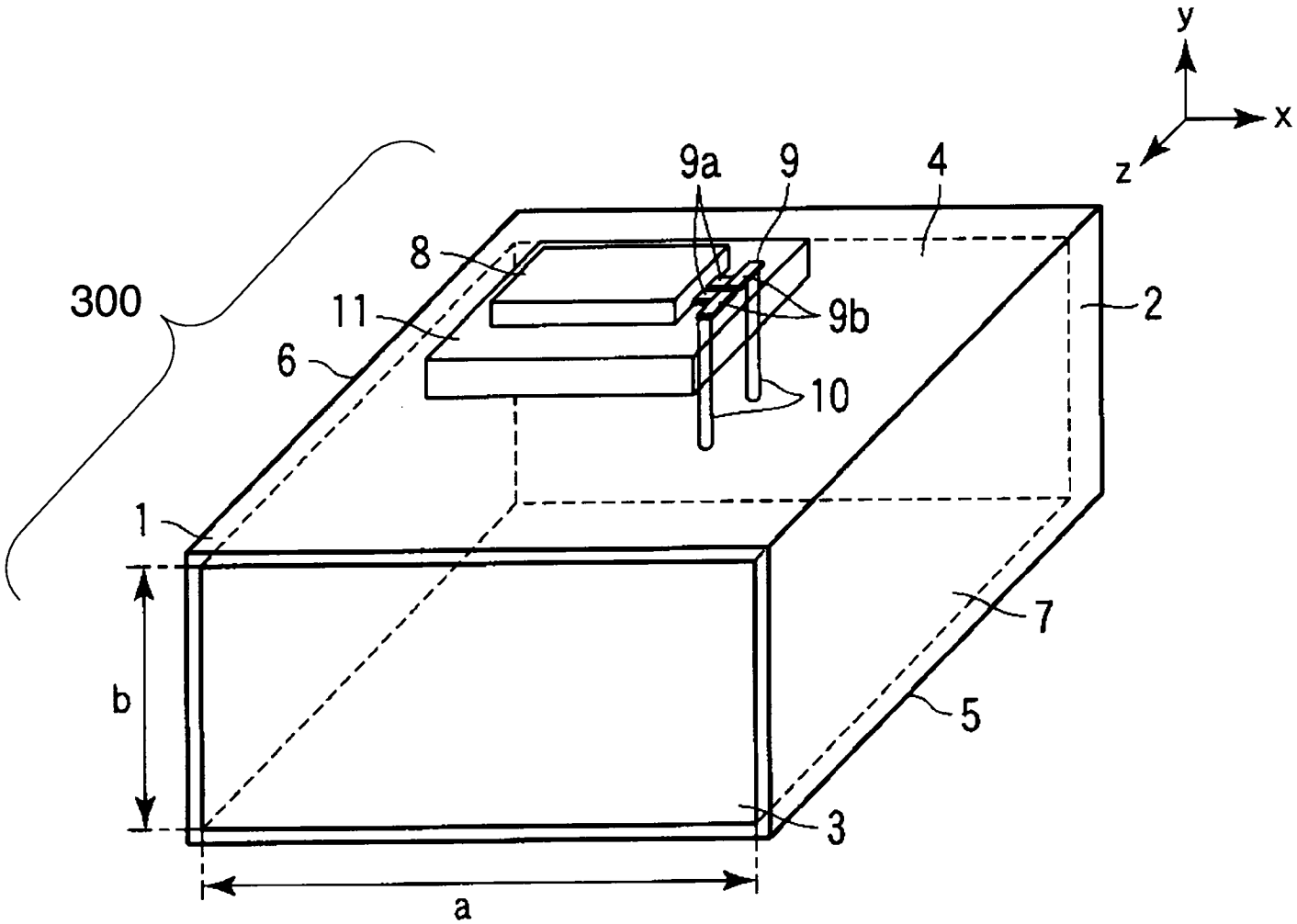
FIG. 5 is a perspective view of a transformer between a waveguide and a transmission-line according to the third embodiment.

As shown in FIG. 5, a transformer between waveguide and transmission-line 300 is almost same as that in the first embodiment except that a dielectric substrate 11 exists between the high-frequency circuit module 8 and the upper wall 4 of the waveguide 1.

The high-frequency circuit module 8 is set on the dielectric substrate 11. The two transmission-lines 9 and feed pins 10 are formed on the dielectric substrate 11. It is easier to form the transmission-lines 9 and feed pins 10 on the dielectric substrate 11 compared with forming them on the waveguide 1.

The transmission-lines 9 may be a microstrip line or a coplanar waveguide which emits less radiation. The feed pins 10 may be via holes through the dielectric substrate 11.

Description of the Fourth Embodiment

Figure 6:
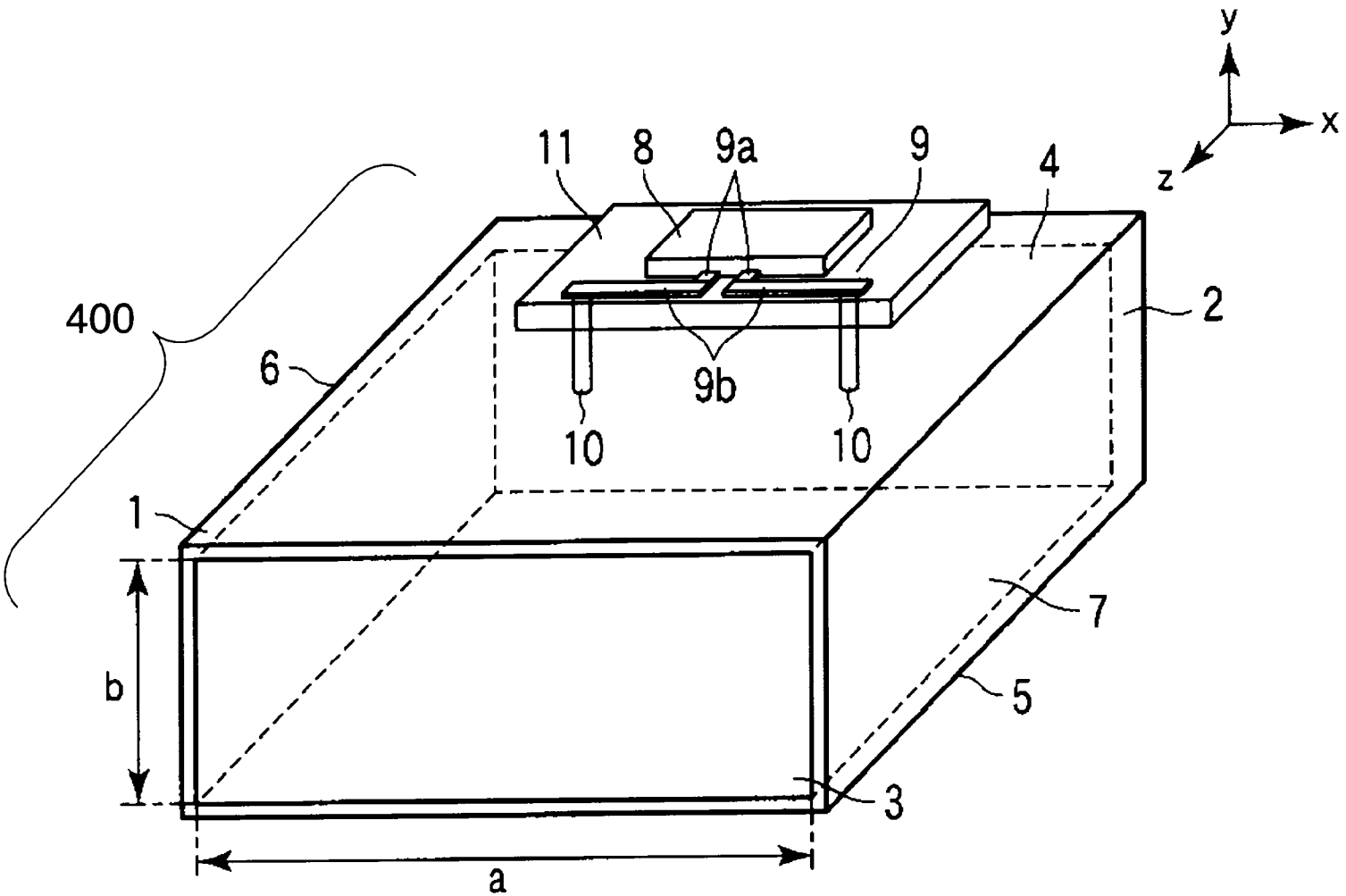
FIG. 6 is a perspective view of a transformer between a waveguide and a transmission-line according to the fourth embodiment.

As shown in FIG. 6, a transformer between waveguide and transmission-line 400 is almost same as that in the second embodiment except that a dielectric substrate 11 exists between the high-frequency circuit module 8 and the upper wall 4 of the waveguide 1.

The high-frequency circuit module 8 is set on the dielectric substrate 11. The two transmission-lines 9 and feed pins 10 are formed on the dielectric substrate 11. It is easier to form the transmission-lines 9 and feed pins 10 on the dielectric substrate 11 compared with forming them on the waveguide 1.

The transmission-lines 9 may be a microstrip line or a coplanar waveguide which emits less radiation. The feed pins 10 may be via holes through the dielectric substrate 11.

Description of the Fifth Embodiment

Figure 7:
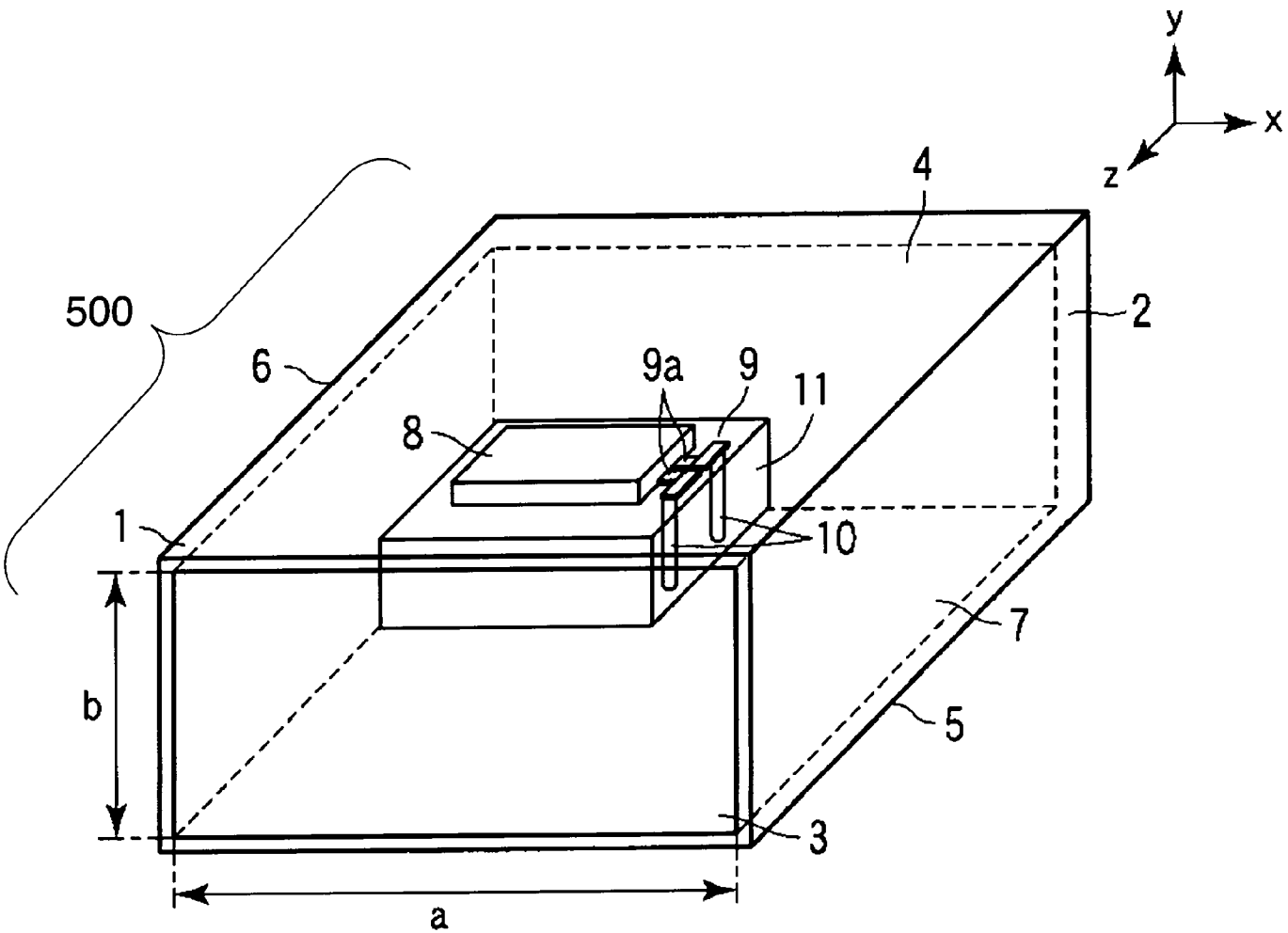
FIG. 7 is a perspective view of a transformer between a waveguide and a transmission-line according to the fifth embodiment.

As shown in FIG. 7, a transformer between waveguide and transmission-line 500 has almost same components as that in the third embodiment. The different point between the fifth and third embodiments is that the high-frequency circuit module 8, the transmission-lines 9, the feed pins 10 and the dielectric substrate 11 are set inside the waveguide 1.

The dielectric substrate 11 is set on the lower wall 5 of the waveguide 1. The high-frequency circuit module 8 is set on the dielectric substrate 11. The two transmission-lines 9 and feed pins 10 are formed on the dielectric substrate 11. The feed pins 10 may be via holes through the dielectric substrate 11. One end of the feed pins 10 are attached to the inner wall of the waveguide 1.

Next, operation of the transformer between waveguide and transmission-line 500 for transmission will be explained using FIGS. 8A, 8B, and 8C.

Figure 8A:
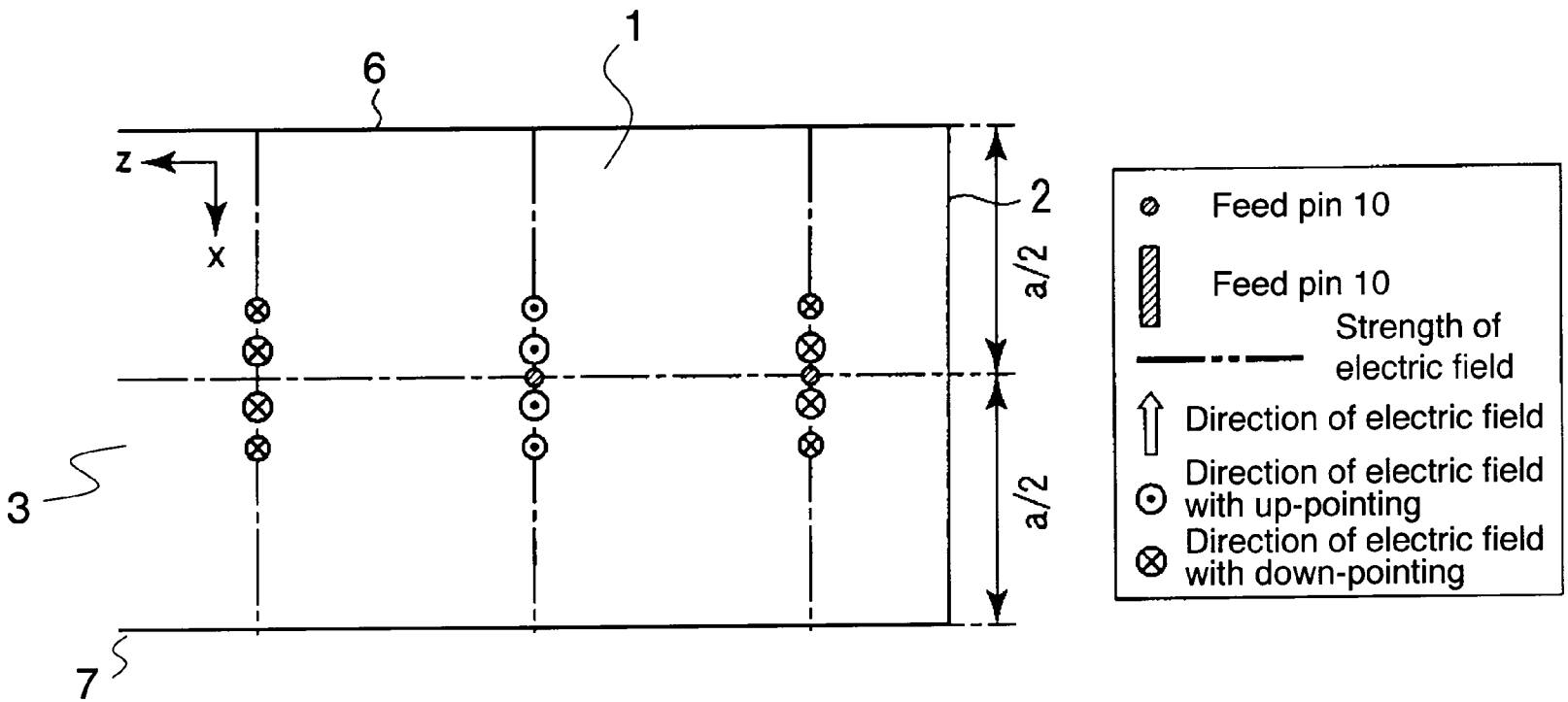
FIGS. 8A, 8B, and 8C are sectional views of the transformer between a waveguide and a transmission-line.
Figure 8B:
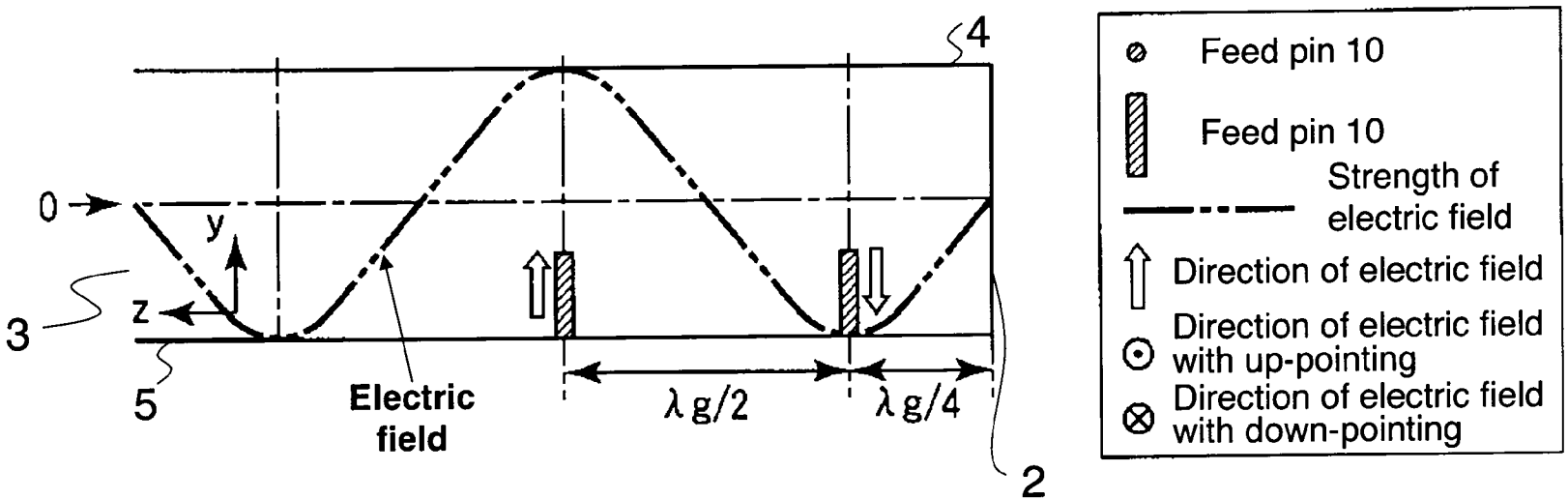
Figure 8C:
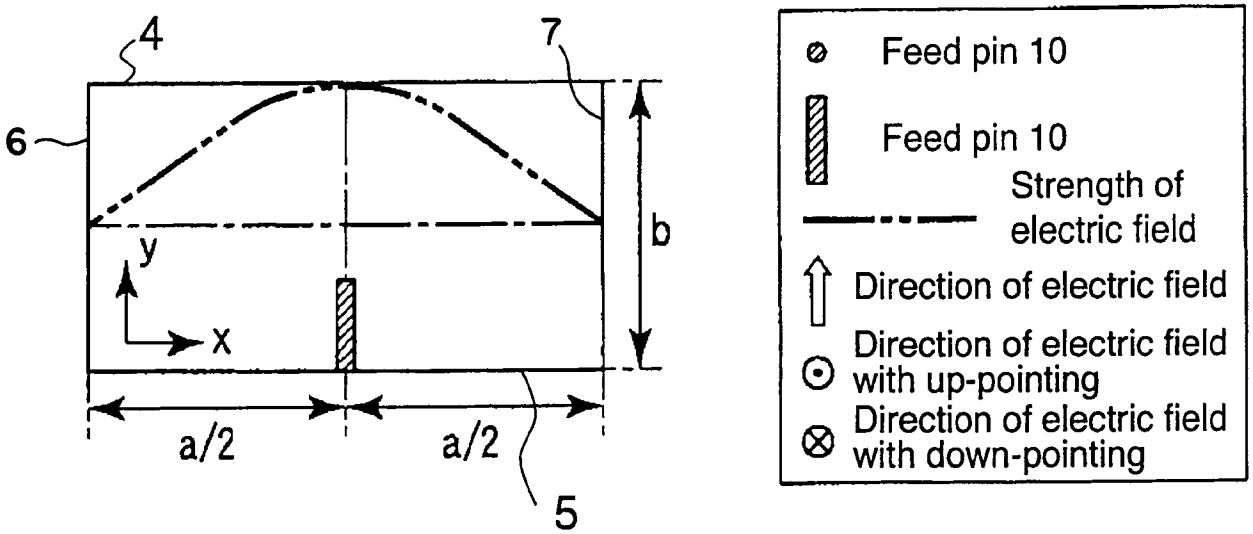

FIGS. 8A, 8B, and 8C show cross-sections along the xz-plane, yz-plane, xy-plane of FIG. 7, respectively. The high-frequency circuit module 8 and the transmission-lines 9 are not shown for simplicity. The electric field is based on the TE10 mode. FIGS. 8A, 8B, 8C show the feed pin 10, the strength of electric field, and the direction of electric field, and with both up-pointing and down pointing.

As shown in FIG. 8C, strength of the electric field is "0" (node) at side walls 6, 7. Moreover, the strength of the electric field has a loop at a center of the waveguide between the sidewalls 6, 7.

As shown in FIG. 8B, the strength of the electric field is "0" (node) at the first end plane 2. Moreover, the strength of the electric field is maximum (loop) at a position having a distance of ($\lambda g*(1+2\alpha)/4$) away from the first end plane 2, where "$\alpha$" is an integer which is equal or larger than "0". Adjacent loops of the electric field have opposite phases from each other as designated by the oppositely directed arrows.

The differential signals, which have opposite from phases each other, are current in the two feed pins 10. These differential signals generate the electric fields with opposite phases from each other and the electric field is based on the TE10 mode. As a result, the feed pins 10, which are arranged as shown in FIG. 7, generate the single-ended signal of the TE10 mode for transmission.

In the case of reception, the single-ended signal of the TE10 mode is converted to the differential signal in the feed pin 10 by performing inverse operations from operations for transmission.

According to the fifth embodiment, the transformer between waveguide and transmission-line 500 converts the differential signal to the single-ended signal in the TE10 mode without a complex structure such as using a balun. Moreover, the antenna device using the transformer between waveguide and transmission-line 500 can be thinner because it does not have a layer of the feed circuit.

Moreover, according to the fifth embodiment, since the high-frequency circuit module 8, the transmission-lines 9, the feed pins 10, and the dielectric substrate 11 exist inside the waveguide 1, the size of the transformer between waveguide and transmission-line 500 can be smaller.

Moreover, according to the fifth embodiment, since one end of the dielectric substrate 11 which is opposite side of the other side having the feed pins 10 is attached to the waveguide 1, the end of the dielectric substrate 11 has low impedance. Therefore, the feed pins 10 easily catch the electric field in order to convert the differential signal to the single-ended signal of the TE10 mode.

Moreover, according to the fifth embodiment, the high-frequency circuit module 8 does not influence the electric field inside the waveguide 1 by setting the high-frequency circuit module 8 at a middle of the two feed pins 10. A line (not shown), which connects the waveguide 1 with other external module (not shown), may also be arranged at a middle of the two feed pins 10 in order to avoid influencing the electric field.

Hereinafter, we describe simulation results using the transformer between waveguide and transmission-line 500. In the simulations, the high-frequency circuit module 8 and the dielectric substrate 11 are eliminated from the transformer for simplicity. A first port is connected to the transmission-lines 9, and a second port is connected to the waveguide 1 in order to input/output signals from outside for the simulations. Moreover, "a" is set to 3.8 [mm] and "b" is set to 1.9 [mm]. The cut-off frequency is 39.5 [GHz] in the TE10 mode.

Figure 9:
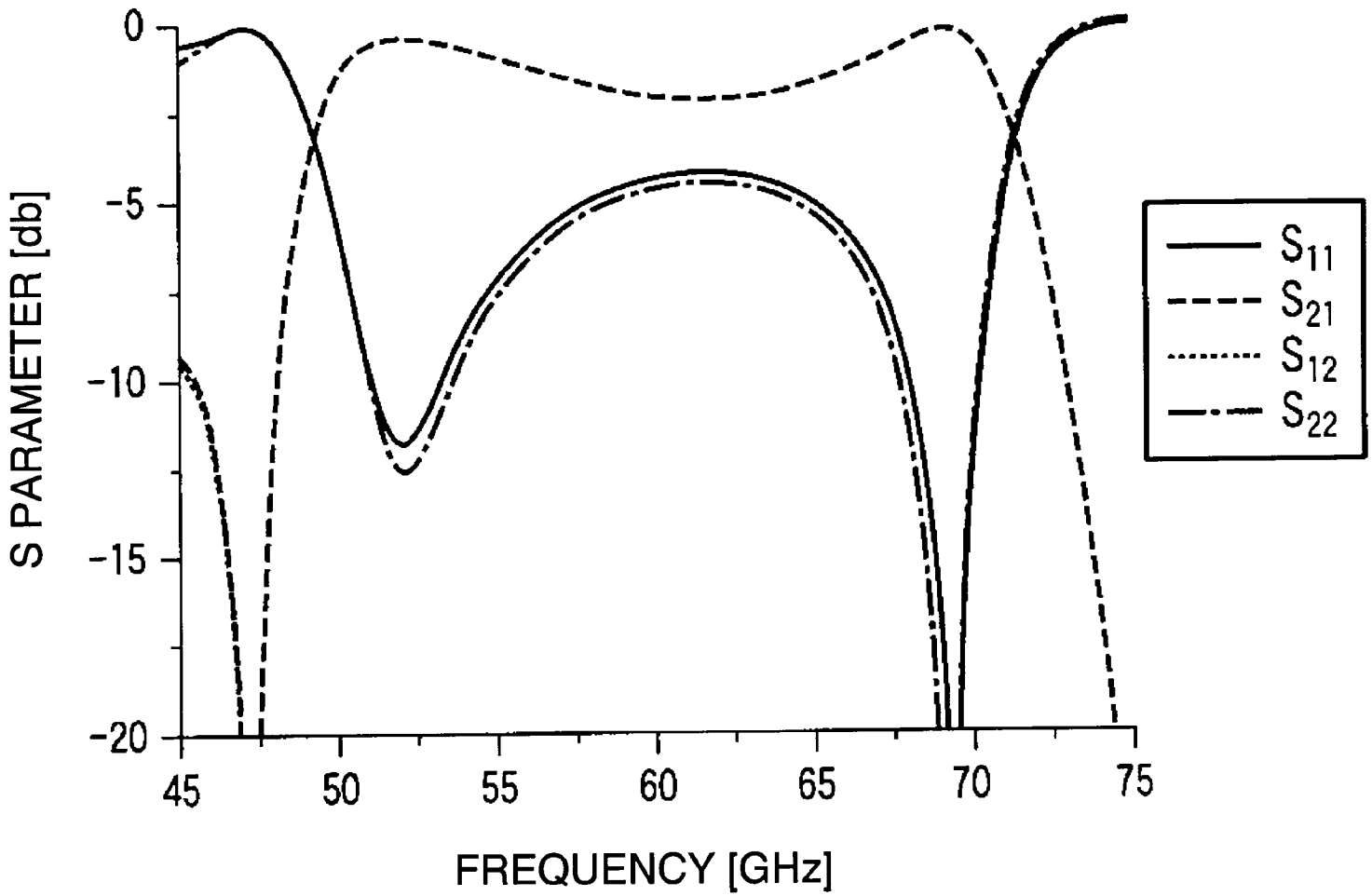
FIG. 9 is a simulation result of S-parameter performance.

FIG. 9 shows S-parameter in dB (including S11, S12, S21, S22) performance versus frequency in GHz. When S11 and S22 are small, it means that input signals from the first and second ports are not reflected and are transmitted smoothly. Also, when S21 and S12 are large, the input signals from the first and second ports are smoothly transmitted to the second and first ports, respectively. In FIG. 9, we can see that S11 and S22 are small and S21 and S12 are large in the frequency of 50 [GHz] to 70 [GHz].

Figure 10A:
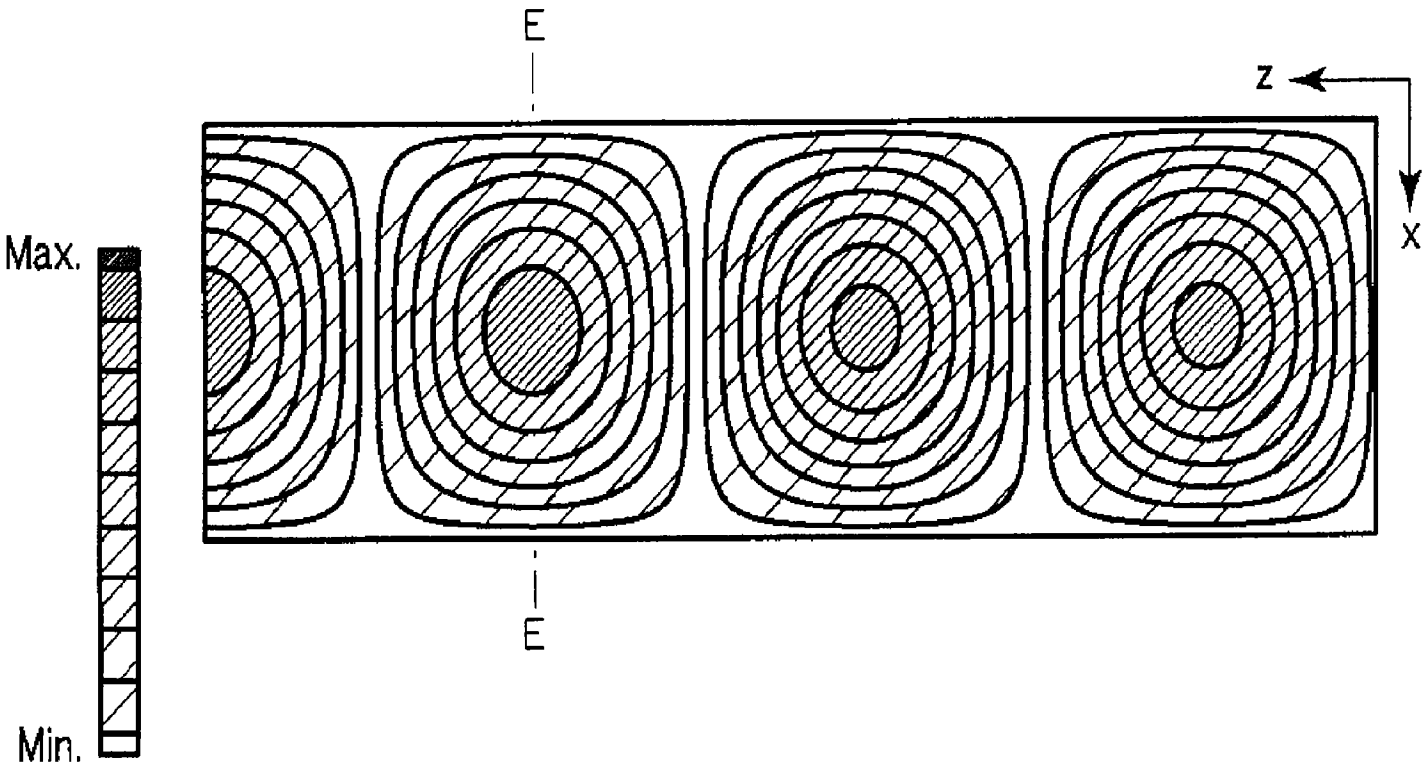
FIGS. 10A and 10B are simulation results of strength of electric field.
Figure 10B:
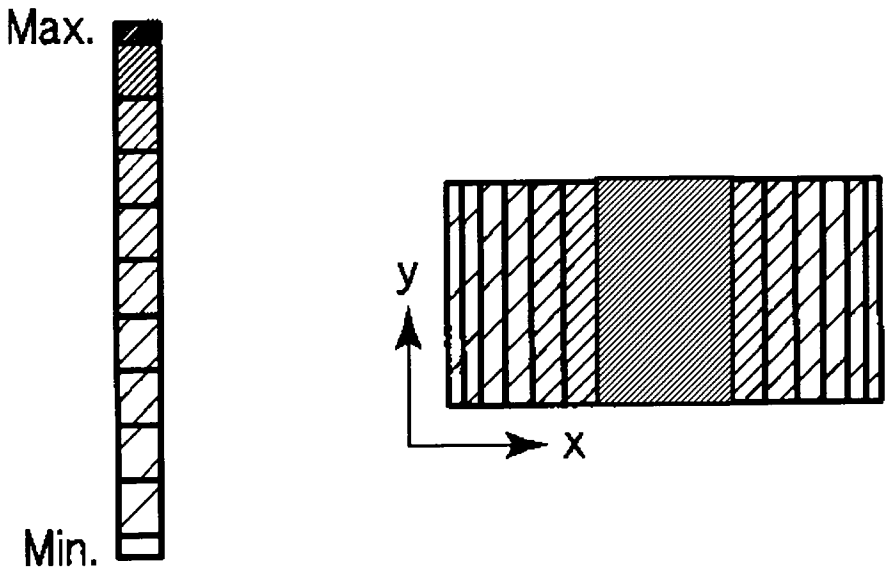

FIGS. 10A and 10B show strength from a Max. to Min. of electric field in the waveguide 1. FIGS. 10A and 10B are cross-sections along the xz-plane and xy-plane of FIG. 7, respectively. Also, FIG. 10B is along a line E of FIG. 10A. The electric field in the waveguide 1 appears based on the TE10 mode by inputting a signal to the first port. The operating frequency may be adjusted by changing height of the feed pins 10.

According to FIG. 9, FIGS. 10A and 10B, the transformer between waveguide and transmission-line 500 can convert the differential signal to the single-ended signal of the TE10 mode.

Description of the Sixth Embodiment

Figure 11:
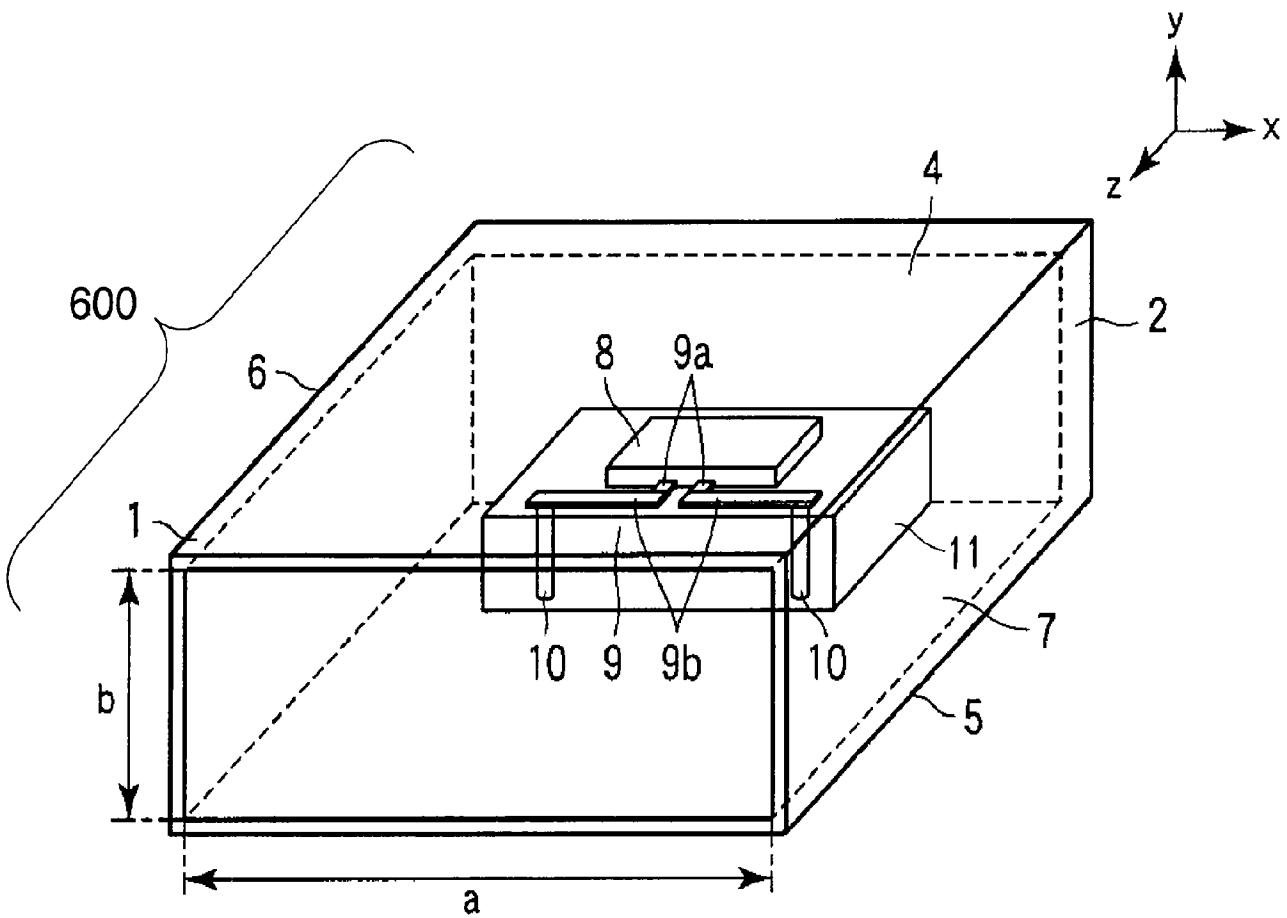
FIG. 11 is a perspective view of a transformer between a waveguide and a transmission-line according to the sixth embodiment.

As shown in FIG. 11, a transformer between waveguide and transmission-line 600 has almost same components as that in the fourth embodiment. The different point between the sixth and fourth embodiments is that the high-frequency circuit module 8, the transmission-lines 9, the feed pins 10 and the dielectric substrate 11 are set inside the waveguide 1.

The dielectric substrate 11 is set on the lower wall 5 of the waveguide 1. The high-frequency circuit module 8 is set on the dielectric substrate 11. The two transmission-lines 9 and feed pins 10 are formed on the dielectric substrate 11. One end of the dielectric substrate 11 is attached to the waveguide 1. In FIG. 11, the length of the waveguide 1 along the x-axis is "a" and the length of the waveguide 1 along the y-axis is "b".

Next, operation of the transformer between waveguide and transmission-line 600 for transmission will be explained using FIGS. 12A, 12B, and 12C.

Figure 12A:
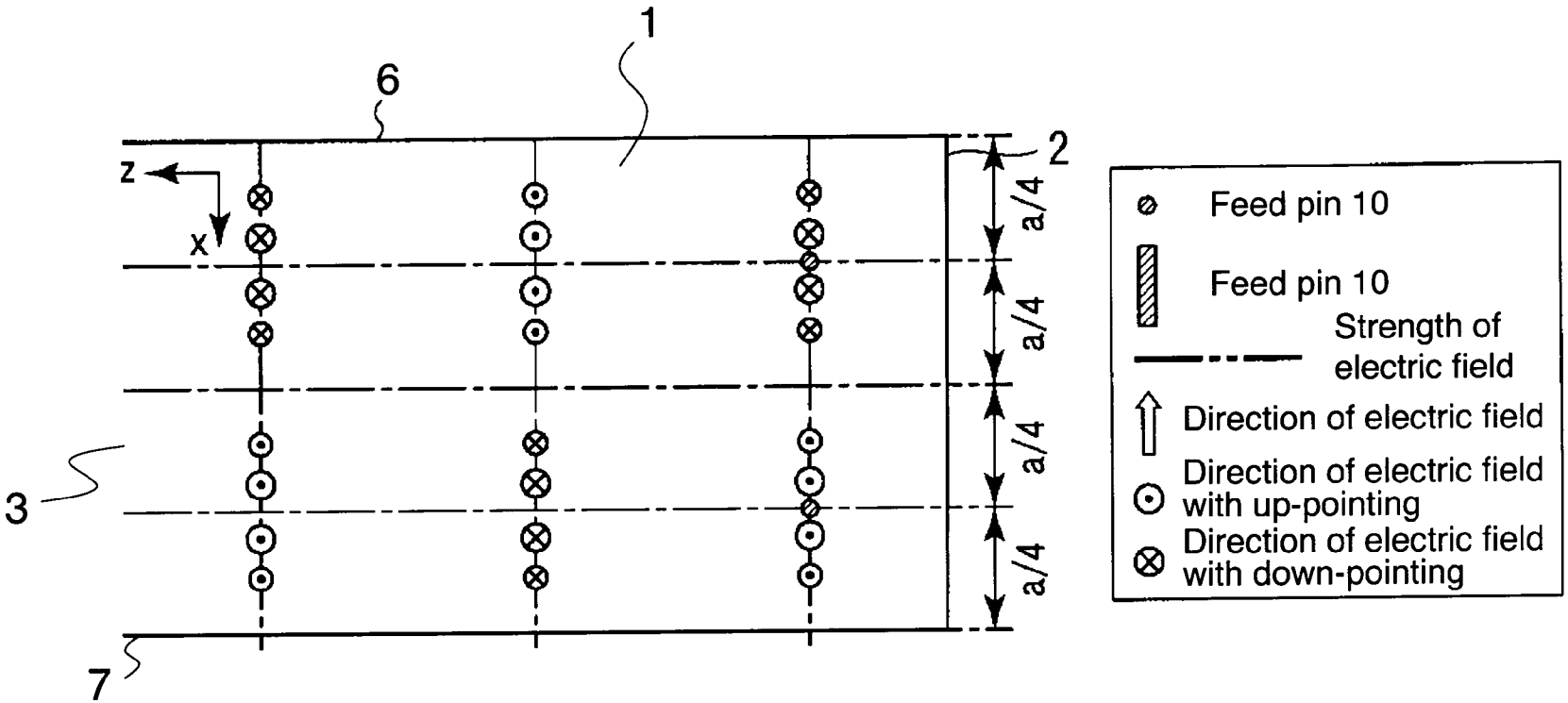
FIGS. 12A, 12B, and 12C are sectional views of the transformer between a waveguide and a transmission-line.
Figure 12B:
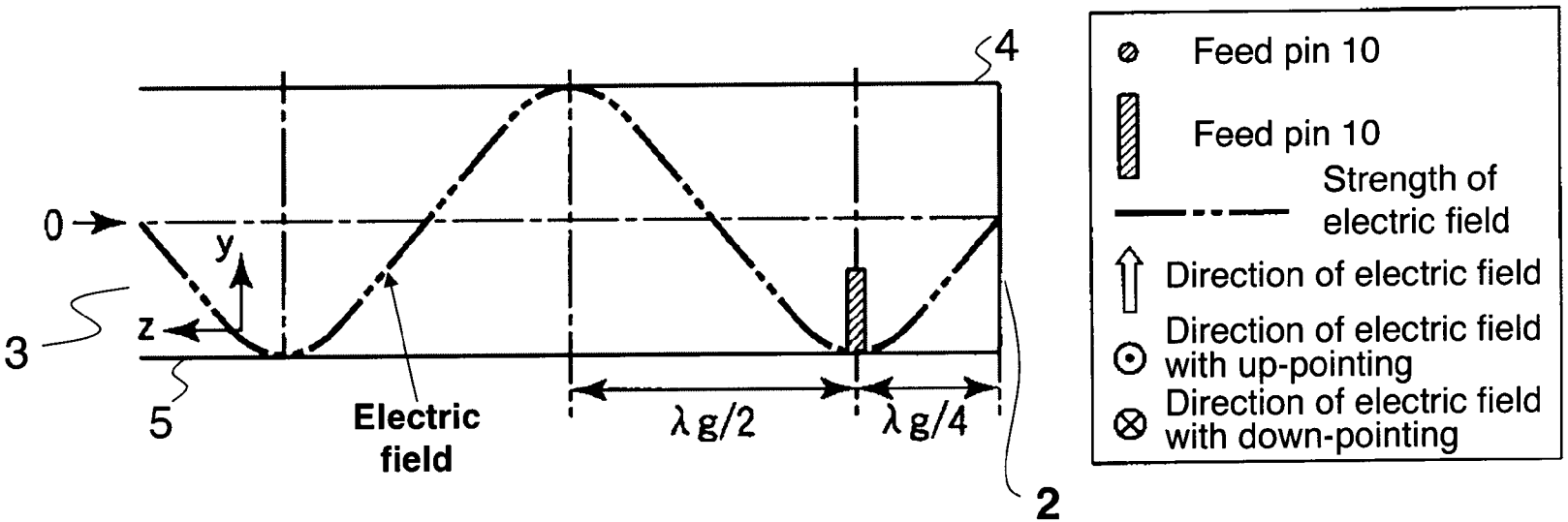
Figure 12C:
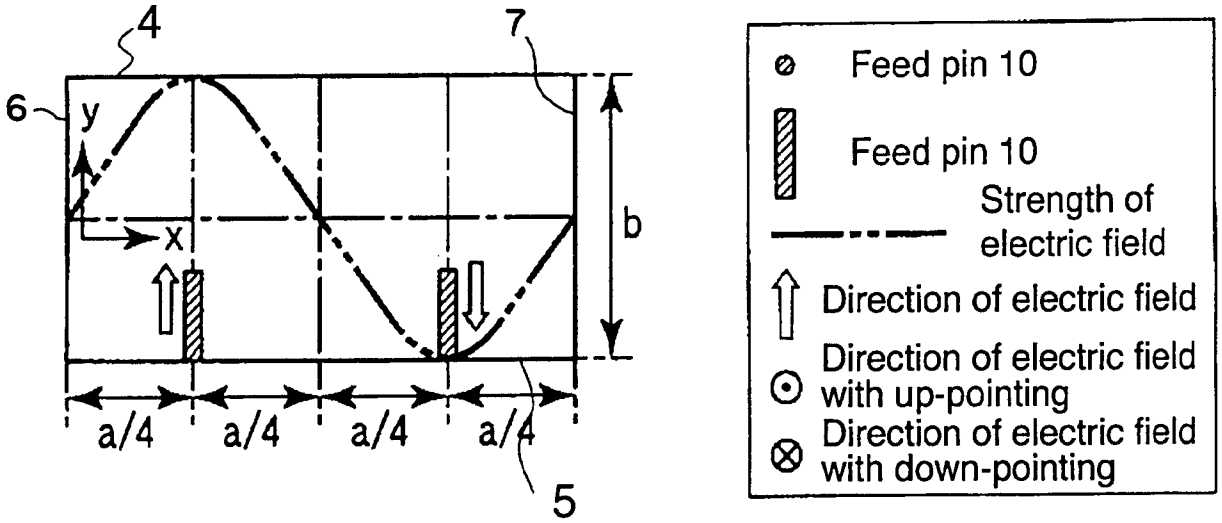

FIGS. 12A, 12B, and 12C show cross-sections along the xz-plane, yz-plane, xy-plane of FIG. 11, respectively. The high-frequency circuit module 8 and the transmission-lines 9 are not shown for simplicity. The electric field is based on the TE20 mode. FIGS. 12A, 12B, 12C show the feed pin 10, the strength of electric field, and the direction of electric field, and with both up-pointing and down pointing.

As shown in FIG. 12C, strength of the electric field is "0" (node) at side walls 6, 7. Moreover, the strength of the electric field has loops at positions having a distance of (a/4) from the side walls 6,7. Adjacent loops of the electric field have opposite phases each other.

As shown in FIG. 12B, the strength of the electric field is "0" (node) at the first end plane 2. Moreover, the strength of the electric field has loops at positions having a distance of ($(1+2\alpha)/4$) away from the first end plane 2, where "$\alpha$" is an integer which is equal or larger than "0". Adjacent loops of the electric field have opposite phases from each other as designated by the oppositely directed arrows.

The differential signals, which have opposite phases each other, are current in the two feed pins 10. These differential signals generate the electric fields with opposite phases each other and the electric field is based on the TE20 mode. As a result, the feed pins 10, which are arranged as shown in FIGS. 12A-12C, generate the single-ended signal of the TE20 mode for transmission.

In the case of reception, the single-ended signal of the TE20 mode is converted to the differential signal in the feed pin 10 by performing inverse operations from operations for transmission.

According to the sixth embodiment, the transformer between waveguide and transmission-line 600 converts the differential signal to the single-ended signal in the TE20 mode without a complex structure such as using a balun. Moreover, the antenna device using the transformer between waveguide and transmission-line 600 can be thinner because it does not have a layer of the feed circuit.

Moreover, according to the sixth embodiment, since the high-frequency circuit module 8, the transmission-lines 9, the feed pins 10, and the dielectric substrate 11 exist inside the waveguide 1, the size of the transformer between waveguide and transmission-line 600 can be smaller.

Moreover, according to the sixth embodiment, since one end of the dielectric substrate 11 which is opposite side of the other side having the feed pins 10 is attached to the waveguide 1, the end of the dielectric substrate 11 has low impedance. Therefore, the feed pins 10 easily catch the electric field in order to convert the differential signal to the single-ended signal of the TE20 mode.

Moreover, according to the sixth embodiment, the high-frequency circuit module 8 does not influence the electric field inside the waveguide 1 by setting the high-frequency circuit module 8 at a middle of the two feed pins 10. A line (not shown), which connects the waveguide 1 with other external module (not shown), may also be arranged at a middle of the two feed pins 10 in order to avoid influencing the electric field.

Hereinafter, we describe simulation results using the transformer between waveguide and transmission-line 600. In the simulations, the high-frequency circuit module 8 and the dielectric substrate 11 are eliminated from the transformer for simplicity. A first port is connected to the transmission-lines 9, and a second port is connected to the waveguide 1 in order to input/output signals from outside for the simulations. Moreover, "a" is set to 7.0 [mm] and "b" is set to 1.9 [mm]. The cut-off frequency is 42.9 [GHz] in the TE20 mode.

Figure 13:
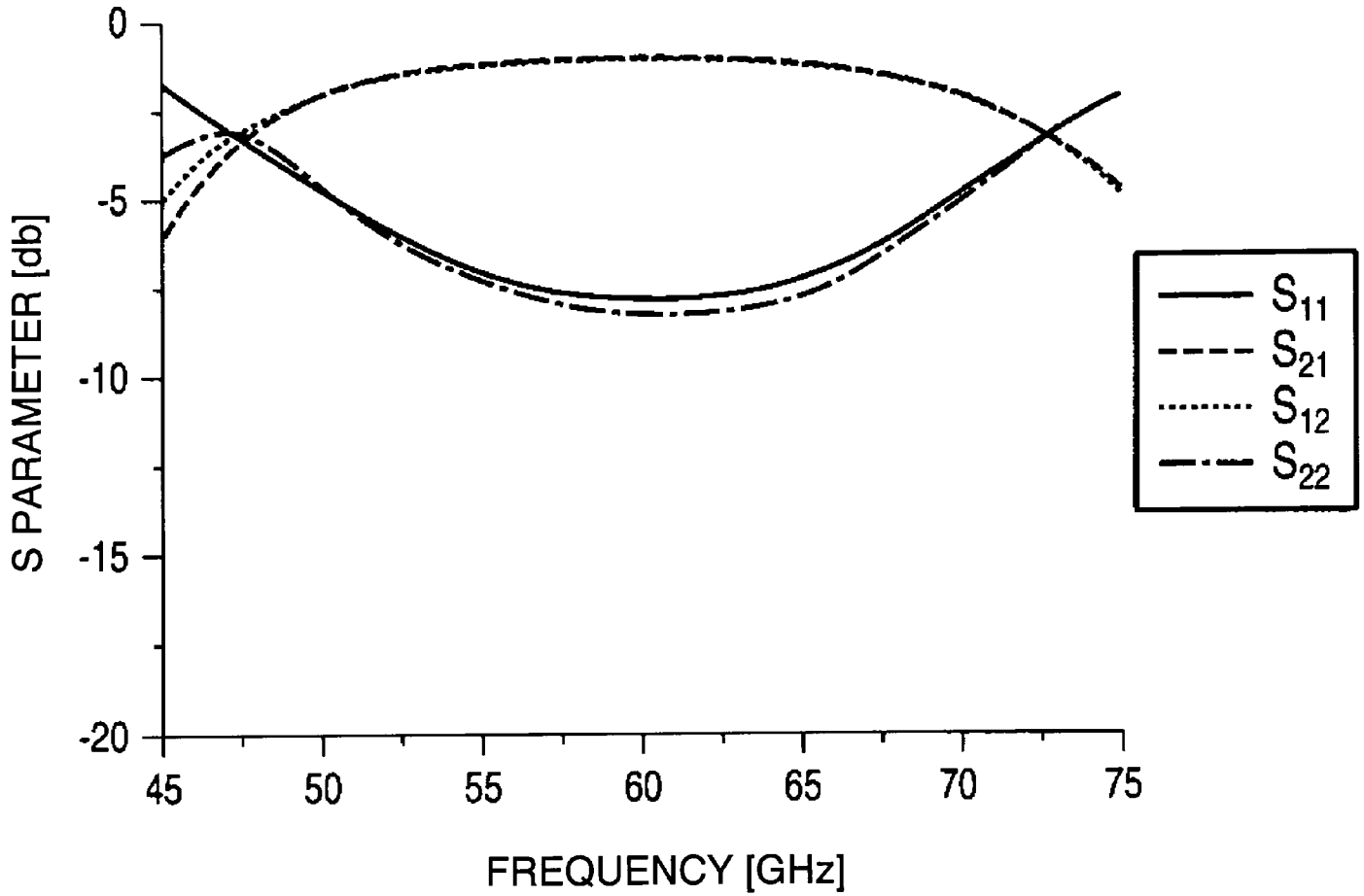
FIG. 13 is a simulation result of S-parameter performance.

FIG. 13 shows S-parameter in dB (including S11, S12, S21, S22) performance versus frequency in GHz. When S11 and S22 are small, it means that input signals from the first and second ports are not reflected and are transmitted smoothly. Also, when S21 and S12 are large, the input signals from the first and second ports are smoothly transmitted to the second and first ports, respectively. In FIG. 13, we can see that S11 and S22 are small and S21 and S12 are large in the frequency of 50 [GHz] to 70 [GHz].

Figure 14A:
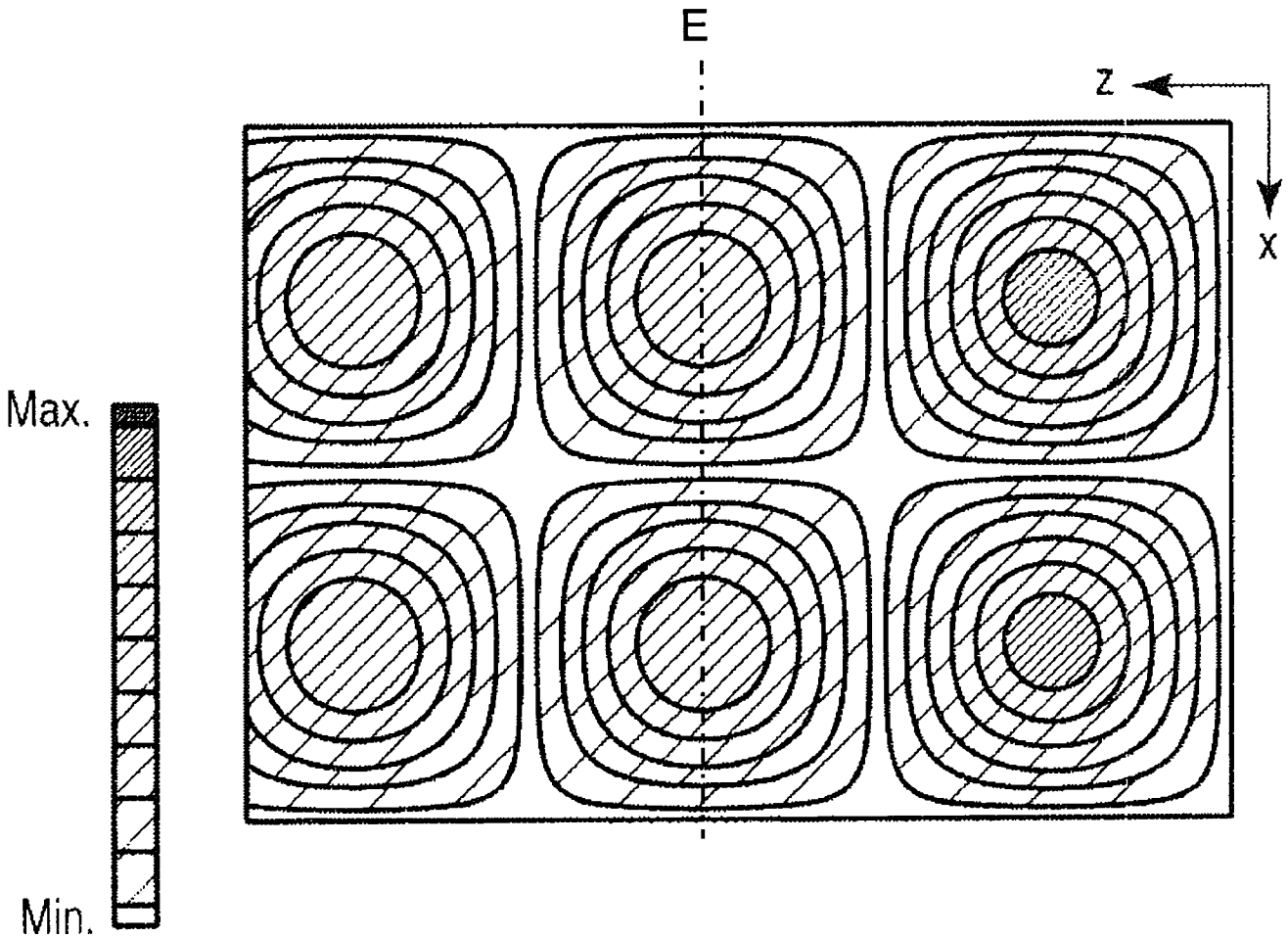
FIGS. 14A and 14B are simulation results of strength of electric field.
Figure 14B:
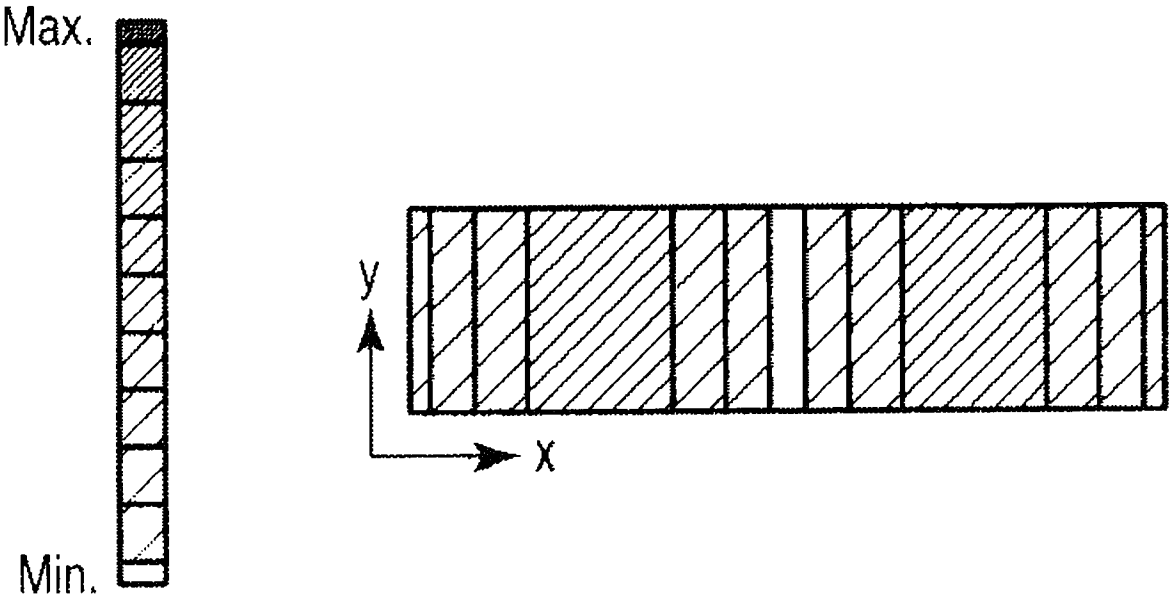

FIGS. 14A and 14B show strength from a Max. to Min. of electric field in the waveguide 1. FIGS. 14A and 14B are cross-sections along the xz-plane and xy-plane of FIG. 11, respectively. Also, FIG. 14B is along a line E of FIG. 14A. Since "a" is 7.0 [mm], the cut-off frequency is 42.9 [GHz] in the TE20 mode. The electric field in the waveguide 1 appears due to the TE20 mode by inputting a signal to the first port. The operating frequency may be adjusted by changing height of the feed pins 10.

According to FIG. 13, FIGS. 14A and 14B, the transformer between waveguide and transmission-line 600 can convert the differential signal to the single-ended signal of the TE20 mode.

Description of the Seventh Embodiment

Figure 15:
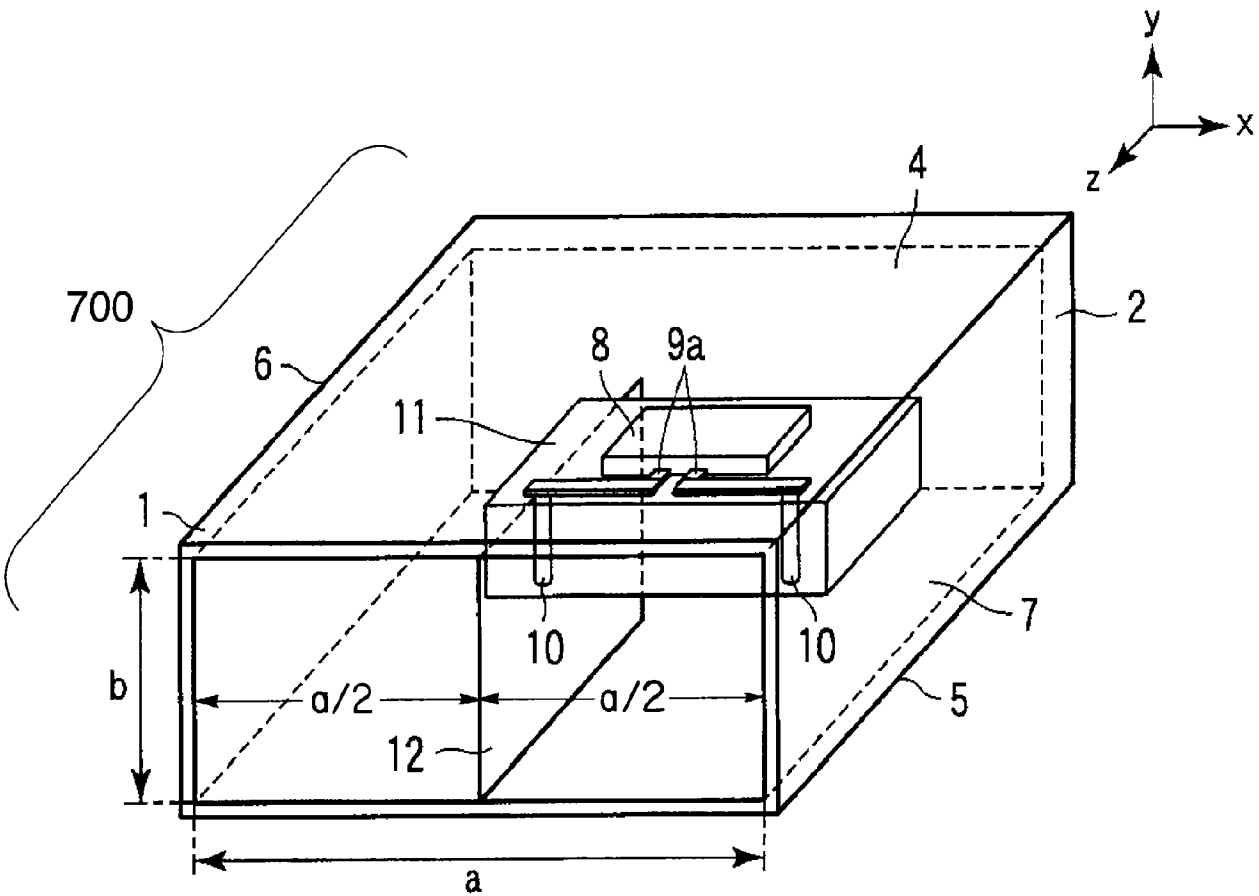
FIG. 15 is a perspective view of a transformer between a waveguide and a transmission-line according to the seventh embodiment.

As shown in FIG. 15, a transformer between waveguide and transmission-line 700 has almost same as that in the sixth embodiment except that a metal wall 12 exists. The metal wall 12 is set at the middle of the waveguide between the side walls 6, 7 along the z-axis inside the waveguide 1. Therefore, the metal wall 12 has a distance of (a/2) away from the both side walls 6, 7. The metal wall 12 may be a metal post-wall having many through holes instead of a metal plate.

The transformer between waveguide and transmission-line 700 operates as same as the sixth embodiment. The electric field in the transformer between waveguide and transmission-line 700 is based on the TE20 mode. That is the electric field has two electric fields of the TE10 mode along the x-axis as shown in FIG. 12A.

The metal wall 12 isolates the electric field of the TE20 mode to the two electric fields of the TE10 mode. Therefore, if one of the two electric field of the TE10 mode is cluttered, the other electric field of the TE10 can maintain a regular condition without receiving influence from the one electric field. The metal wall 12 may exist in the transformer between waveguide and transmission-line of the second or fourth embodiment to gain the above effect.

Description of the Eighth Embodiment

Figure 16:
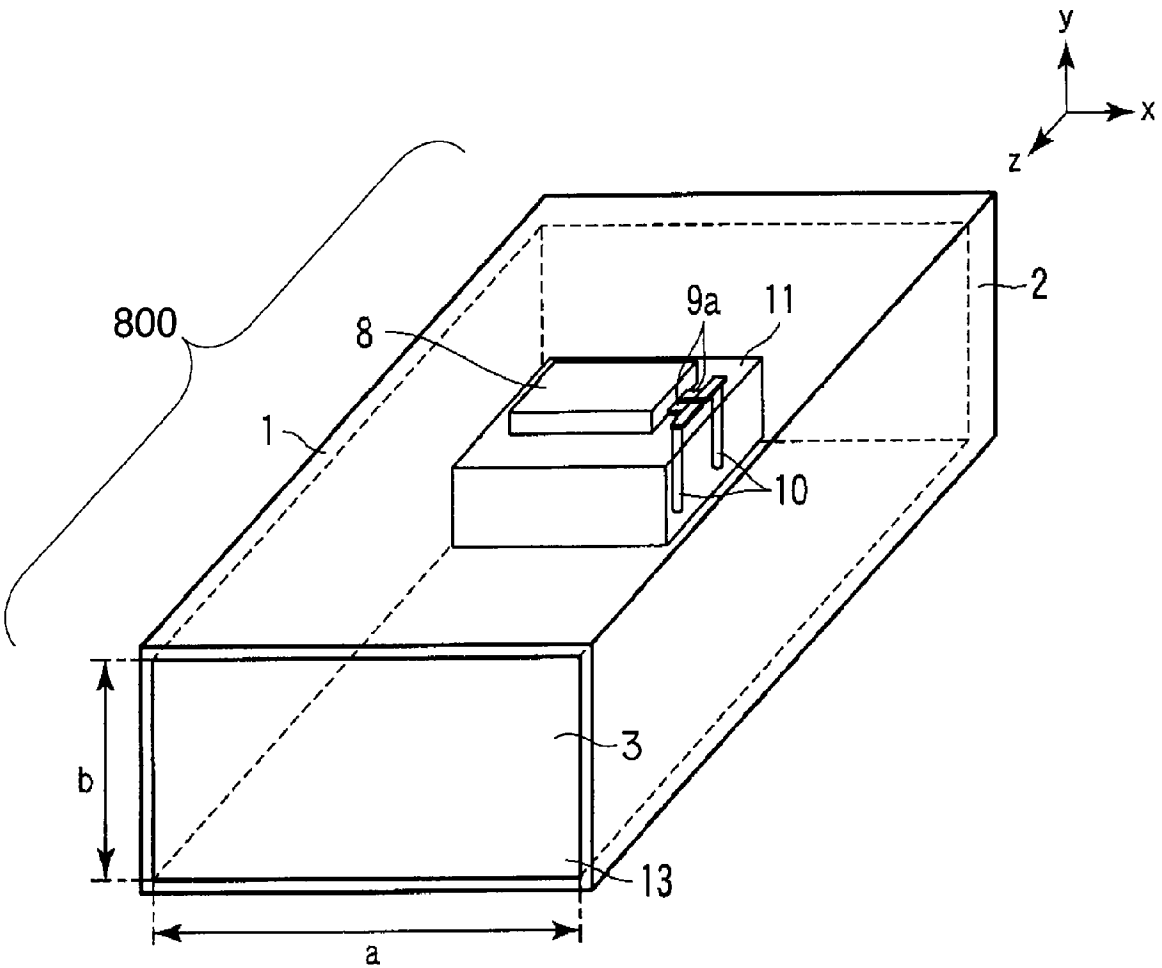
FIG. 16 is a perspective view of a transformer between a waveguide and a transmission-line according to the eighth embodiment.

As shown in FIG. 16, an antenna device 800 has almost same as that in the fifth embodiment.

An antenna device is obtained by opening an aperture 13 on the second end plane 3 of the transformer between waveguide and transmission-line 500. Radio waves are radiated by the feed pins 10 to the direction which is opposite of the first end plane 2 through the aperture 13. The aperture 13 may be larger in size than the first end plane 2 to obtain a horn antenna.

On the other hand, the feed pins 10 receive radio waves from outside through the aperture 13. Moreover, if the aperture 13 is also open on the second end plane 3 of each transformer between the waveguide and the transmission-lines 100 and 300, the antenna device using the apertures 13 will operate the same as in the eighth embodiment.

Description of the Ninth Embodiment

Figure 17:
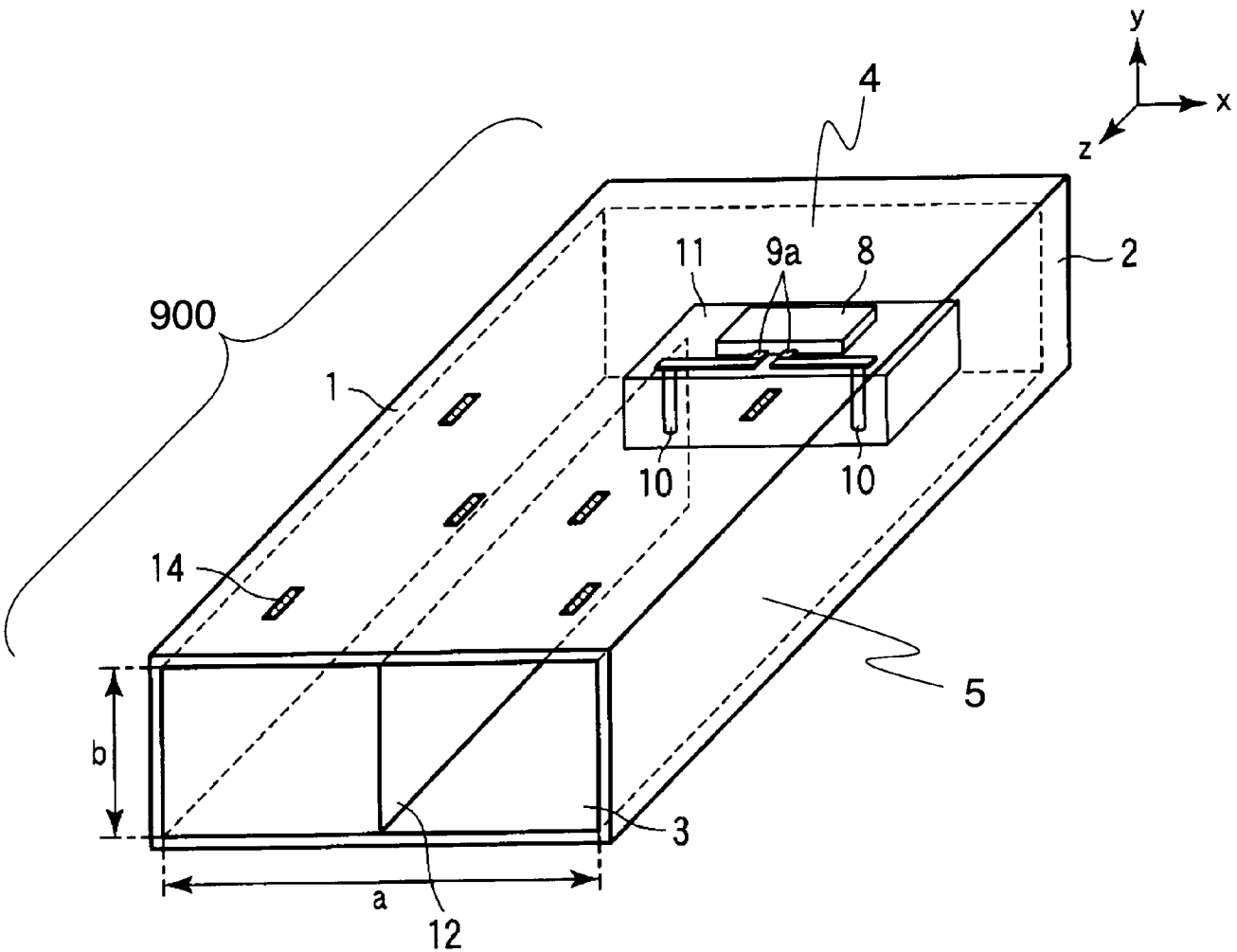
FIG. 17 is a perspective view of a transformer between a waveguide and a transmission-line according to the ninth embodiment.

As shown in FIG. 17, an antenna device 900 has almost same as that in the seventh embodiment. A slot antenna device is obtained by opening slots 14 in the upper wall 4. The second end plane 3 is a metal plate. Alternatively, the second end plane 3 may be an aperture or a register. Radio waves are radiated by the feed pins 10 to air through the opening slots 14.

The slots 14 are symmetrically arranged about the metal wall 12. On the other hand, the electric field in the transformer between waveguide and transmission-line 900 is based on the TE20 mode. The metal wall 12 isolates the electric field of the TE20 mode to the two electric fields of the TE10 mode. Therefore, directions of radiation from the slots 14 can be regular. For example, the slot antenna device radiates a maximum power to the direction of the y-axis. The direction of the maximum power is changed by adjusting arrangement of the slots 14. The slots 14 may be along other direction such as the x-axis or inclined to the axis. Also, the slots 14 may has other shape such as square, circle, and ellipse.

According to the ninth embodiment, the slot antenna device can be obtained by opening slots 14 on the waveguide 1. Since the high-frequency circuit module 8 exists inside the slot antenna device, it achieves small size.

The slots 14 may also exist in the waveguide 1 of the FIGS. 1, 3, 5, 6, 7 and 11 to obtain the slot antenna device.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A transformer between a waveguide and a transmission-line, comprising:

a high-frequency circuit module having differential-pair terminals through which a differential signal is output;

transmission-lines, each being connected to one of the differential-pair terminals;

a waveguide including first and second metal walls parallel to each other and ends of the first and second metal walls are connected to each other through a third metal wall; and feed pins being arranged inside of the waveguide, each feed pin being directly connected to a respective one of the transmission-lines, having a first distance of approximately ($\lambda g/2$) away from each other, one of the feed pins having a second distance of approximately ($\lambda g*(1+2\alpha)/4$) away from the third metal wall, "$\lambda g$" is a wavelength in the waveguide, and "$\alpha$" is an integer which is equal or larger than "0", wherein each of the feed pins has a third distance of approximately (a/2) away from the first or second wall, "a" is length of the waveguide along the third metal wall, and wherein the differential signals are output from the high-frequency circuit module into the waveguide through the feed pins being directly connected to the transmission-lines.

2. An antenna device, comprising:

the transformer of claim 1; and an aperture or a plurality of slots being provided in the waveguide of the transformer to radiate radio waves resulting from the differential signal output into the waveguide.

3. The transformer of claim 1, wherein the transmission-lines are comprised of either a microstrip line or a coplanar waveguide.

4. The transformer of claim 1, further comprising a dielectric substrate, wherein the high-frequency circuit module, the transmission-lines and the feed pins are formed on the dielectric substrate.

5. The transformer of claim 4, wherein the high-frequency circuit module, the transmission-lines, the feed pins, and the dielectric substrate are set inside the waveguide.

6. The transformer of claim 5, wherein the feed pins are respectively attached at an end thereof to an inside wall of the waveguide.

7. The transformer of claim 5, wherein the feed pins include via holes extending through the dielectric substrate.

8. The transformer of claim 1, wherein "a" is larger than ($\lambda/2$), where "$\lambda$" is a free-space wavelength.

* * * * *